US007635841B2

(12) United States Patent
Bateman et al.

(10) Patent No.: US 7,635,841 B2
(45) Date of Patent: Dec. 22, 2009

(54) METHOD OF MASS SPECTROMETRY

(75) Inventors: Robert Harold Bateman, Knutsford (GB); John Brian Hoyes, Cheshire (GB); Jason Lee Wildgoose, Cheshire (GB); Anthony James Gilbert, Cheshire (GB)

(73) Assignee: Micromass UK Limited (GB)

( * ) Notice: Subject to any disclaimer, the term of this patent is extended or adjusted under 35 U.S.C. 154(b) by 892 days.

(21) Appl. No.: 10/498,046

(22) PCT Filed: Dec. 12, 2002

(86) PCT No.: PCT/GB02/05628

§ 371 (c)(1),
(2), (4) Date: Feb. 11, 2005

(87) PCT Pub. No.: WO03/050843

PCT Pub. Date: Jun. 19, 2003

(65) Prior Publication Data

US 2005/0118724 A1 Jun. 2, 2005

Related U.S. Application Data

(60) Provisional application No. 60/401,517, filed on Aug. 7, 2002.

(30) Foreign Application Priority Data

Dec. 12, 2001 (GB) ..... 0129693.8
Jul. 5, 2002 (GB) ..... 0215626.3
Jul. 25, 2002 (GB) ..... 0217217.9

(51) Int. Cl.
*H01J 49/00* (2006.01)

(52) U.S. Cl. ..... 250/292; 250/290; 250/283; 250/282; 250/281

(58) Field of Classification Search ..... 250/282, 250/281, 290, 293, 292, 283
See application file for complete search history.

(56) References Cited

U.S. PATENT DOCUMENTS 5,420,425 A 5/1995 Bier
5,763,878 A 6/1998 Franzen (Continued)

FOREIGN PATENT DOCUMENTS

GB 2 381 948 A 5/2003

(Continued)

OTHER PUBLICATIONS

Scalf et al., "Controlling Charge States of Large Ions", Jan. 8, 1999, vol. 283, pp. 194-197.*

(Continued)

*Primary Examiner*—Jack I Berman
*Assistant Examiner*—Hanway Chang
(74) *Attorney, Agent, or Firm*—Jamie H. Rose

(57) ABSTRACT

A method of mass spectrometry is disclosed wherein ions are trapped for a period of time T within an AC or RF ion guide maintained at a pressure P wherein the product P×T is at least 1 mbar-ms. The effect of trapping the ions according to a preferred embodiment is that singly charged ions which may, for example, comprise unwanted background ions are substantially lost from the trap whereas multiply charged analyte ions are maintained within the ion trap and can then be released for subsequent mass analysis.

13 Claims, 22 Drawing Sheets

U.S. PATENT DOCUMENTS

| | | | | |
|---|---|---|---|---|
| 5,811,800 | A * | 9/1998 | Franzen et al. | 250/288 |
| 6,797,948 | B1 * | 9/2004 | Wang | 250/292 |
| 6,897,437 | B2 * | 5/2005 | Fuhrer et al. | 250/287 |
| 2002/0175279 | A1 * | 11/2002 | Hager | 250/282 |
| 2002/0190205 | A1 * | 12/2002 | Park | 250/292 |
| 2003/0001084 | A1 * | 1/2003 | Bateman et al. | 250/281 |
| 2003/0071206 | A1 * | 4/2003 | Belov et al. | 250/282 |

FOREIGN PATENT DOCUMENTS

WO WO 01/078106 A3 10/2001

WO WO02/097412 A2 12/2002

OTHER PUBLICATIONS

Tolmachev, et al.; Radial stratification of ions as a function of mass to charge ratio in collisional cooling radio frequency multipoles used as ion guides or ion traps; Rapid Communications in Mass Spectrometry, pp. 1907-1913 (2000).

Guevremont, et al.; Ion trapping at atmospheric pressure (760 Tor) and room temperature with a high-field asymmetric waveform ion mobility spectrometer; International Journal of Mass Spectrometry 193 (1999) 45-56.

* cited by examiner

INTENSITY
%
1560
0
387
m/z
UNK 163 (6.968) Cm (155:165)
[M+2H]2+
[M+3H]3+
817.14
818.13
820.94
821.28
821.61
828.09
822.57
831.55
832.55
838.68
839.68
840.68
844.56
845.04
849.52
853.54
815.59
817.18
817.68
807.63
800.69
797.01
796.31
794.09
787.65
786.66
785.69
782.64
779.64
776.68
768.67
767.69
766.71
820.66
821.34
821.65
838.71
796.37
796.72
797.05
796.04
794.65
782.70
766.73

INTENSITY
%
100
0
m/z
571.4 ++
571.9
572.4
572.9
556.3
557.3
564.4
554.4
525.9
525.4
514.4
496.9
496.4
485.4
474.4
467.2
453.3
445.2
438.3
414.3
413.3
394.1
393.1
374.1
373.1
355.1
347.3
334.9
316.4
301.2
297.6
295.0
557.4
300
320
340
360
380
400
420
440
460
480
500
520
540
560

◆ M2+/M1+
■ M3+/M1+

METHOD OF MASS SPECTROMETRY

With the decoding of the 20-30,000 genes that compose the human genome, emphasis has switched to the identification of the translated gene products that comprise the proteome. Mass spectrometry has firmly established itself as the primary technique for identifying proteins due to its unparalleled speed, sensitivity and specificity. Strategies can involve either analysis of the intact protein or more commonly digestion of the protein using a specific protease that cleaves at predictable residues along the peptide backbone. This provides smaller stretches of peptide sequence which are more amenable to analysis via mass spectrometry.

The mass spectrometry technique providing the highest degree of specificity and sensitivity is Electrospray Ionisation ("ESI") interfaced to a tandem mass spectrometer allowing fragmentation studies by low energy MS/MS. These experiments involve separation of the complex digest mixture by microcapillary liquid chromatography with on-line mass spectral detection using automated acquisition modes whereby conventional MS and MS/MS spectra are collected in a data dependant manner. This information can be used directly to search databases for matching sequences leading to identification of the parent protein. This approach has recently allowed the identification of proteins that are present at low endogenous concentrations. However, often the limiting factor for identification of the protein is not the quality of the MS/MS spectrum produced but is the initial identification of the multiply charged peptide precursor ion in the MS mode. This is due to the level of background chemical noise, largely singly charged in nature, which may be produced in the ion source of the mass spectrometer. FIG. 1 shows a conventional mass spectrum and shows how doubly charged species may be obscured in a singly charged background.

It would be desirable to reduce the singly charged chemical noise thereby allowing the mass spectrometer to specifically target multiply charged peptide related ions. The ability to be able to discriminate against singly charged ions in favour of multiply charged ions would be particularly advantageous for the study of protein digests.

With an Electrospray Ionisation orthogonal acceleration Time of flight ("ESI-oaTOF") mass spectrometer it is known to favour the transmission of multiply charged species in preference to singly charged species by increasing the discriminator voltage and/or lowering the gain. The orthogonal acceleration Time of Flight mass spectrometer counts the arrival of ions using a Time to Digital Converter ("TDC") which has a discriminator threshold. The voltage pulse of a single ion must be high enough to trigger the discriminator and so register the arrival of an ion. The detector producing the voltage may be an electron multiplier or Microchannel Plate detector ("MCP"). These detectors are charge sensitive so the size of signal they produce increases with increasing charge state. Discrimination in favour of higher charge states may therefore be accomplished by either increasing the discriminator voltage level of the TDC and/or by lowering the detector gain or a combination of both. FIG. 2A shows a conventional mass spectrum obtained with an orthogonal acceleration Time of Flight mass spectrometer and FIG. 2B shows a corresponding mass spectrum obtained by lowering the gain of the ion detector. As can be seen from comparing FIGS. 2A and 2B one of the disadvantages of this technique is that lowering the gain and/or increasing the discriminator level decreases the detection efficiency for the desired charge state and hence the sensitivity is reduced. Furthermore, it is impossible pick out an individual charge state according to this method. All that can be done is to reduce the efficiency of detection of lower charge states with respect to higher charge states.

It is therefore desired to be able to preferentially transmit multiply charged ions whilst attenuating singly charged ions without substantially reducing sensitivity.

According to the present invention there is provided a method of mass spectrometry, comprising:

trapping a plurality of ions in an AC or RF ion guide in the presence of a gas at a pressure P for a period of time T, wherein the product P×T is at least 1 mbar-ms.

Preferably, the product P×T is at least 2, 3, 4, 5, 6, 7, 8, 9, 10, 20, 30, 40, 50, 60, 70, 80, 90, 100, 110, 120, 130, 140, 150, 160, 170, 180, 190, 200, 210, 220, 230, 240, 250, 260, 270, 280, 290, 300, 310, 320, 330, 340, 350, 360, 370, 380, 390, 400, 410, 420, 430, 440, 450, 460, 470, 480, 490, 500, 550, 600, 650, 700, 750, 800, 850, 900, 950 or 1000, 1100, 1200, 1300, 1400, 1500, 1600, 1700, 1800, 1900, 2000, 2500, 3000, 3500, 4000, 4500, 5000, 5500, 6000, 6500, 7000, 7500, 8000, 8500, 9000, 9500 or 10000 mbar-ms.

Preferably, the product P×T is less than 2, 3, 4, 5, 6, 7, 8, 9, 10, 20, 30, 40, 50, 60, 70, 80, 90, 100, 110, 120, 130, 140, 150, 160, 170, 180, 190, 200, 210, 220, 230, 240, 250, 260, 270, 280, 290, 300, 310, 320, 330, 340, 350, 360, 370, 380, 390, 400, 410, 420, 430, 440, 450, 460, 470, 480, 490, 500, 550, 600, 650, 700, 750, 800, 850, 900, 950 or 1000, 1100, 1200, 1300, 1400, 1500, 1600, 1700, 1800, 1900, 2000, 2500, 3000, 3500, 4000, 4500, 5000, 5500, 6000, 6500, 7000, 7500, 8000, 8500, 9000, 9500 or 10000 mbar-ms.

Preferably, T falls within a range selected from the group consisting of: (i) 50-100 μs; (ii) 100-150 μs; (iii) 150-200 μs; (iv) 200-250 μs; (v) 250-300 μs; (vi) 300-350 μs; (vii) 350-400 μs; (viii) 400-450 μs; (ix) 450-500 μs; (x) 500-550 μs; (xi) 550-600 μs; (xii) 600-650 μs; (xiii) 650-700 μs; (xiv) 700-750 μs; (xv) 750-800 μs; (xvi) 800-850 μs; (xvii) 850-900 μs; (xviii) 900-950 μs; and (xix) 950-1000 μs. Preferably, T falls within a range selected from the group consisting of: (i) 1-2 ms; (ii) 2-3 ms; (iii) 3-4 ms; (iv) 4-5 ms; (v) 5-6 ms; (vi) 6-7 ms; (vii) 7-8 ms; (viii) 8-9 ms; and (ix) 9-10 ms. Preferably, T falls within a range selected from the group consisting of: (i) 10-15 ms; (ii) 15-20 ms; (iii) 20-25 ms; (iv) 25-30 ms; (v) 30-35 ms; (vi) 35-40 ms; (vii) 40-45 ms; (viii) 45-50 ms; (ix) 50-55 ms; (x) 55-60 ms; (xi) 60-65 ms; (xii) 65-70 ms; (xiii) 70-75 ms; (xiv) 75-80 ms; (xv) 80-85 ms; (xvi) 85-90 ms; (xvii) 90-95 ms; and (xviii) 95-100 ms. Preferably, T falls within a range selected from the group consisting of: (i) 100-110 ms; (ii) 110-120 ms; (iii) 120-130 ms; (iv) 130-140 ms; (v) 140-150 ms; (vi) 150-160 ms; (vii) 160-170 ms; (viii) 170-180 ms; (ix) 180-190 ms; and (x) 190-200 ms. Preferably, T falls within a range selected from the group consisting of: (i) 200-250 ms; (ii) 250-300 ms; (iii) 300-350 ms; (iv) 350-400 ms; (v) 400-450 ms; (vi) 450-500 ms; (vii) 500-550 ms; (viii) 550-600 ms; (ix) 600-650 ms; (x) 650-700 ms; (xi) 700-750 ms; (xii) 750-800 ms; (xiii) 800-850 ms; (xiv) 850-900 ms; (xv) 900-950 ms; and (xvi) 950-1000 ms.

Preferably, T is at least than: (i) 50 μs; (ii) 60 μs (iii) 70 μs; (iv) 80 μs; (v) 90 μs; or (vi) 100 μs. Preferably, T is at least: (i) 200 μs; (ii) 300 μs (iii) 400 μs; (iv) 500 μs; (v) 600 μs; (vi) 700 μs; (vii) 800 μs; (viii) 900 μs; or (ix) 1000 μs. Preferably, T is at least: (i) 2 ms; (ii) 3 ms (iii) 4 ms; (iv) 5 ms; (v) 6 ms; (vi) 7 ms; (vii) 8 ms; (viii) 9 ms; or (ix) 10 ms. Preferably, T is at least: (i) 20 ms; (ii) 30 ms (iii) 40 ms; (iv) 50 ms; (v) 60 ms; (vi) 70 ms; (vii) 80 ms; (viii) 90 ms; or (ix) 100 ms. Preferably, T is at least: (i) 100 ms; (ii) 200 ms (iii) 300 ms; (iv) 400 ms; (v) 500 ms; (vi) 600 ms; (vii) 700 ms; (viii) 800 ms; or (ix) 900 ms. Preferably, T is at least: (i) 1 s; (ii) 2 s; (iii) 3 s; (iv) 4 s; (v)

5 s; (vi) 6 s; (vii) 8 s; (viii) 9 s; or (ix) 10 s. Preferably, T is less than: (i) 10 s; (ii) 9 s; (iii) 8 s; (iv) 7 s; (v) 6 s; (vi) 5 s; (vii) 4 s; (viii) 3 s; or (ix) 2 s.

Preferably, T is less than: (i) 1000 ms; (ii) 900 ms (iii) 800 ms; (iv) 700 ms; (v) 600 ms; (vi) 500 ms; (vii) 400 ms; (viii) 300 ms; or (ix) 200 ms. Preferably, T is less than: (i) 100 ms; (ii) 90 ms (iii) 80 ms; (iv) 70 ms; (v) 60 ms; (vi) 50 ms; (vii) 40 ms; (viii) 30 ms; or (ix) 20 ms. Preferably, T is less than: (i) 10 ms; (ii) 9 ms (iii) 8 ms; (iv) 7 ms; (v) 6 ms; (vi) 5 ms; (vii) 4 ms; (viii) 3 ms; or (ix) 2 ms. Preferably, T is less than: (i) 1000 μs; (ii) 900 μs (iii) 800 μs; (iv) 700 μs; (v) 600 μs; (vi) 500 μs; (vii) 400 μs; (viii) 300 μs; or (ix) 200 μs. Preferably, T is less than: (i) 100 μs; (ii) 90 μs (iii) 80 μs; (iv) 70 μs; (v) 60 μs; or (vi) 50 μs.

Preferably, P falls within a range selected from the group consisting of: (i) 0.01-0.02 mbar; (ii) 0.02-0.03 mbar; (iii) 0.03-0.04 mbar; (iv) 0.04-0.05 mbar; (v) 0.05-0.06 mbar; (vi) 0.06-0.07 mbar; (vii) 0.07-0.08 mbar; (viii) 0.08-0.09 mbar; and (ix) 0.09-0.10 mbar. Preferably, P falls within a range selected from the group consisting of: (i) 0.1-0.2 mbar; (ii) 0.2-0.3 mbar; (iii) 0.3-0.4 mbar; (iv) 0.4-0.5 mbar; (v) 0.5-0.6 mbar; (vi) 0.6-0.7 mbar; (vii) 0.7-0.8 mbar; (viii) 0.8-0.9 mbar; and (ix) 0.9-1.0 mbar. Preferably, P falls within a range selected from the group consisting of: (i) 1-2 mbar; (ii) 2-3 mbar; (iii) 3-4 mbar; (iv) 4-5 mbar; (v) 5-6 mbar; (vi) 6-7 mbar; (vii) 7-8 mbar; (viii) 8-9 mbar; and (ix) 9-10 mbar. Preferably, P falls within a range selected from the group consisting of: (i) 10-20 mbar; (ii) 20-30 mbar; (iii) 30-40 mbar; (iv) 40-50 mbar; (v) 50-60 mbar; (vi) 60-70 mbar; (vii) 70-80 mbar; (viii) 80-90 mbar; and (ix) 90-100 mbar.

Preferably, P is at least: (i) 0.01 mbar; (ii) 0.02 mbar; (iii) 0.03 mbar; (iv) 0.04 mbar; (v) 0.05 mbar; (vi) 0.06 mbar; (vii) 0.07 mbar; (viii) 0.08 mbar; or (ix) 0.09 mbar. Preferably, P is at least: (i) 0.1 mbar; (ii) 0.2 mbar; (iii) 0.3 mbar; (iv) 0.4 mbar; (v) 0.5 mbar; (vi) 0.6 mbar; (vii) 0.7 mbar; (viii) 0.8 mbar; or (ix) 0.9 mbar. Preferably, P is at least: (i) 1 mbar; (ii) 2 mbar; (iii) 3 mbar; (iv) 4 mbar; (v) 5 mbar; (vi) 6 mbar; (vii) 7 mbar; (viii) 8 mbar; or (ix) 9 mbar. Preferably, P is at least: (i) 10 mbar; (ii) 20 mbar; (iii) 30 mbar; (iv) 40 mbar; (v) 50 mbar; (vi) 60 mbar; (vii) 70 mbar; (viii) 80 mbar; (ix) 90 mbar; or (x) 100 mbar.

Preferably, P is less than: (i) 100 mbar; (ii) 90 mbar; (iii) 80 mbar; (iv) 70 mbar; (v) 60 mbar; (vi) 50 mbar; (vii) 40 mbar; (viii) 30 mbar; or (ix) 20 mbar. Preferably, P is less than: (i) 10 mbar; (ii) 9 mbar; (iii) 8 mbar; (iv) 7 mbar; (v) 6 mbar; (vi) 5 mbar; (vii) 4 mbar; (viii) 3 mbar; or (ix) 2 mbar. Preferably, P is less than: (i) 1 mbar; (ii) 0.9 mbar; (iii) 0.8 mbar; (iv) 0.7 mbar; (v) 0.6 mbar; (vi) 0.5 mbar; (vii) 0.4 mbar; (viii) 0.3 mbar; or (ix) 0.2 mbar. Preferably, P is less than: (i) 0.10 mbar; (ii) 0.09 mbar; (iii) 0.08 mbar; (iv) 0.07 mbar; (v) 0.06 mbar; (vi) 0.05 mbar; (vii) 0.04 mbar; (viii) 0.03 mbar; or (ix) 0.02 mbar.

Preferably, P is selected from the group consisting of: (i)>0.01 mbar; (ii)>0.05 mbar; (iii)>0.1 mbar; (iv)>0.2 mbar; (v)>0.5 mbar; (vi)>1 mbar; (vii)>2 mbar; (viii)>5 mbar; and (ix)>10 mbar.

The sample of ions preferably comprises at least some ions having similar or substantially the same mass to charge ratios but different charge states. The at least some ions may have similar or substantially the same mass to charge ratios preferably wherein the mass to charge ratios differ by less than: (i) 20 mass to charge units; (ii) 15 mass to charge units; (iii) 10 mass to charge units; (iv) 5 mass to charge units; (v) 4 mass to charge units; (vi) 3 mass to charge units; (vii) 2 mass to charge units; and (viii) 1 mass to charge unit, wherein 1 mass to charge unit equals 1 dalton per unit of electronic charge.

The plurality of ions may comprise a plurality of ionised molecules, the molecules comprising a plurality of different biopolymers, proteins, peptides, polypeptides, oligionucleotides, oligionucleosides, amino acids, carbohydrates, sugars, lipids, fatty acids, vitamins, hormones, portions or fragments of DNA, portions or fragments of cDNA, portions or fragments of RNA, portions or fragments of mRNA, portions or fragments of tRNA, polyclonal antibodies, monoclonal antibodies, ribonucleases, enzymes, metabolites, polysaccharides, phosphorolated peptides, phosphorolated proteins, glycopeptides, glycoproteins or steroids.

According to another aspect of the present invention, there is provided a method of enhancing the relative proportion or abundance of multiply charged ions to singly charged ions in a sample of ions, comprising:

trapping the sample of ions in an AC or RF ion guide in the presence of a gas at a pressure P for a period of time T, wherein the product P×T is at least 1 mbar-ms.

According to another aspect of the present invention, there is provided a method of separating analyte ions having a first charge state from background ions having a second charge state, comprising:

trapping a sample of ions in an AC or RF ion guide in the presence of a gas at a pressure P for a period of time T, wherein the product P×T is at least 1 mbar-ms.

Preferably, the first charge state comprises doubly charged ions and/or triply charged ions and/or quadruply charged ions and/or ions having a higher charge state.

Preferably, the second charge state comprises singly charged ions.

At least some analyte ions preferably have a first mass to charge ratio and at least some background ions have a second mass to charge ratio, wherein the first mass to charge ratio differs from the second mass to charge ratio by less than 20, 15, 10, 5, 4, 3, 2 or 1 mass to charge units.

According to another aspect of the present invention, there is provided a method of mass spectrometry comprising:

providing a sample of singly charged ions and doubly charged ions having similar mass to charge ratios;

onwardly transmitting doubly charged ions whilst at least partially relatively attenuating singly charged ions by trapping the sample of ions in an AC or RF ion guide in the presence of a gas at a pressure P for a period of time T, wherein the product P×T is at least 1 mbar-ms; and mass analysing the doubly charged ions.

According to another aspect of the present invention, there is provided a method of discriminating against singly charged ions in favour of doubly charged ions and/or ions of higher charge states, comprising:

transmitting a sample of ions comprising singly charged ions and doubly charged ions and/or ions of higher charge state into an AC or RF ion guide;

maintaining the AC or RF ion guide at a pressure P; and trapping the ions within the ion guide for a period of time T;

wherein the product P×T is at least 1 mbar-ms.

According to another aspect of the present invention, there is provided a method of separating ions having similar or substantially the same mass to charge ratios (m/z) on the basis of their charge state (z), comprising:

trapping the ions within an AC or RF ion guide at a pressure P and for a period of time T, wherein the product P×T is at least 1 mbar-ms.

Preferably, the AC or RF ion guide comprises electrodes and the AC or RF ion guide has a central longitudinal axis, and wherein the combination of pressure and trapping time is such that singly charged ions are forced radially outwards from the central longitudinal axis whereas multiply charged ions are caused to forced towards the central longitudinal axis.

The singly charged ions are preferably substantially ejected from or lost from the AC or RF ion guide, whereas at least some preferably a majority of the multiply charged ions are substantially retained within the AC or RF ion guide.

Preferably, one or more of the following groups of ions are substantially ejected from or lost from the AC or RF ion guide: (i) ions having 2 charges; (ii) ions having 3 charges; (iii) ions having 4 charges; (iv) ions having 5 charges; (v) ions having 6 charges; (vi) ions having 7 charges; (vii) ions having 8 charges; (viii) ions having 9 charges; (ix) ions having 10 charges; (x) ions having 11 charges; (xi) ions having 12 charges; (xii) ions having 13 charges; (xiii) ions having 14 charges; (xiv) ions having 15 charges; (xv) ions having 16 charges; (xvi) ions having 17 charges; (xvii) ions having 18 charges; (xviii) ions having 19 charges; (xix) ions having 20 charges; (xx) ions having 21 charges; (xxi) ions having 22 charges; and (xxii) ions having more than 22 charges.

Preferably, one or more of the following groups of ions are substantially retained with the AC or RF ion guide: (i) ions having 2 charges; (ii) ions having 3 charges; (iii) ions having 4 charges; (iv) ions having 5 charges; (v) ions having 6 charges; (vi) ions having 7 charges; (vii) ions having 8 charges; (viii) ions having 9 charges; (ix) ions having 10 charges; (x) ions having 11 charges; (xi) ions having 12 charges; (xii) ions having 13 charges; (xiii) ions having 14 charges; (xiv) ions having 15 charges; (xv) ions having 16 charges; (xvi) ions having 17 charges; (xvii) ions having 18 charges; (xviii) ions having 19 charges; (xix) ions having 20 charges; (xx) ions having 21 charges; (xxi) ions having 22 charges; and (xxii) ions having more than 22 charges.

According to another aspect of the present invention, there is provided a method of removing unwanted singly charged background ions from a mixture of singly charged background ions and multiply charged analyte ions, the method comprising:

transmitting the mixture of ions to an AC or RF ion guide;

trapping the ions within the AC or RF ion guide maintained at a pressure P;

setting the period of time during which the ions are trapped within the AC or RF ion guide at a value such that at least 50%, 60%, 70%, 80%, 90% or more than 90% of said singly charged ions will be substantially ejected from or lost from the AC or RF ion guide whereas at least 50%, 60%, 70%, 80%, 90% or more than 90% of said multiply charged ions will be substantially maintained within the AC or RF ion guide.

Preferably, the product P×T is at least 1 mbar-ms.

According to another aspect of the present invention, there is provided a method of removing or attenuating singly and/or doubly charged ions from a mixture of at least singly, doubly and triply charged ions, the method comprising:

trapping the mixture of ions within an AC or RF ion guide or ion trap maintained at a pressure P for a period of time T, wherein P×T is at least 1 mbar-ms.

According to another aspect of the present invention, there is provided a mass spectrometer, comprising:

an ion trap comprising an AC or RF ion guide wherein in a mode of operation a plurality of ions are trapped in or otherwise prevented from leaving the ion guide in the presence of a gas at a pressure P for a period of time T, wherein the product P×T is at least 1 mbar-ms.

The mass spectrometer preferably further comprises an ion source for generating mainly molecular or pseudo-molecular ions.

The ion source may comprise an atmospheric pressure ionization source such as an ion source selected from the group comprising: (i) an Electrospray ionisation ("ESI") ion source; (ii) an Atmospheric Pressure Chemical Ionisation ("APCI") ion source; (iii) an Atmospheric Pressure Photo Ionisation ("APPI") ion source; (iv) an atmospheric pressure Matrix Assisted Laser Desorption Ionisation ("MALDI") ion source; and (v) an Inductively Coupled Plasma ("ICP") ion source. Alternatively, the ion source may comprise a non-atmospheric pressure ionization source such as an ion source selected from the group consisting of: (i) a Fast Atom Bombardment ("FAB") ion source; (ii) a Liquid Secondary Ions Mass Spectrometry ("LSIMS") ion source; (iii) a Matrix Assisted Laser Desorption Ionisation ("MALDI") ion source; (iv) a Matrix Assisted Laser Desorption ("MALDI") ion source in combination with a collision cell for collisionally cooling ions; (v) a Laser Desorption Ionisation ("LDI") ion source; (vi) an Electron Impact ("EI") ion source; and (vii) a Chemical Ionisation ("CI") ion source.

Preferably, the AC or RF ion guide comprises a multipole rod set e.g. a quadrupole rod set, a hexapole rod set, an octopole rod set or a rod set having ten or more rods.

Alternatively, the AC or RF ion guide may comprise a plurality of electrodes having apertures through which the ions are transmitted. For example, the AC or RF ion guide may comprise an ion tunnel having a plurality of electrodes each having substantially the same size aperture or an ion funnel having a plurality of electrodes wherein the size of the apertures becomes progressively smaller or larger.

According to another embodiment the AC or RF ion guide may comprise a double helix arrangement of electrodes.

According to a yet further embodiment the AC or RF ion guide may comprise a plurality of plates stacked adjacent to each other.

The mass spectrometer preferably comprises a mass analyzer such as a Time of Flight mass analyzer, a quadrupole mass analyzer, a 2D or 3D ion trap, a Fourier Transform mass spectrometer or a Fourier Transform Ion Cyclotron Resonance mass spectrometer.

According to another aspect of the present invention, there is provided a mass spectrometer comprising a device for substantially removing unwanted singly charged ions from a mixture of singly charged ions and multiply charged ions, the device comprising an AC or RF ion guide which in a mode of operation is operated as an ion trap so that ions are trapped within the AC or RF ion guide for a period of time T, the AC or RF ion guide being maintained in use at a pressure P and wherein the product P×T is at least 1 mbar-ms.

According to another aspect of the present invention, there is provided a mass spectrometer comprising:

an ion source;

a vacuum chamber housing an AC or RF ion guide maintained in use at a pressure P;

an electrode, wherein in a first mode of operation the potential applied to the electrode causes ions to be substantially trapped within the AC or RF ion guide and wherein in a second mode of operation the potential applied to the electrode allows ions to be released from the ion guide;

a further vacuum chamber housing a mass analyzer; and control means arranged to control the period of time T that ions are trapped within the AC or RF ion guide, wherein in a mode of operation the control means arranges that the trapping time T is such that the product P×T is at least 1 mbar-ms.

The mass spectrometer preferably further comprises a further AC or RF ion guide arranged in a further vacuum chamber. A quadrupole mass filter and/or a collision cell may be arranged in a yet further vacuum chamber intermediate the vacuum chamber(s) housing the AC or RF ion guide(s) and the vacuum chamber housing the mass analyzer. The ion source may comprise an atmospheric pressure ion source and the mass analyzer may comprise a Time of Flight mass analyzer.

Preferably, the AC or RF ion guide and/or the further AC or RF ion guide comprises: (i) a multipole rod set; (ii) an ion funnel comprising a plurality of electrodes having apertures therein through which ions are transmitted, wherein the diameter of the apertures becomes progressively smaller or larger; (iii) an ion tunnel comprising a plurality of electrodes having apertures therein through which ions are transmitted, wherein the diameter of the apertures remains substantially constant; (iv) a double helix arrangement of electrodes; and (v) a stack of plates wherein adjacent electrodes are connected to opposite phases of an AC or RF supply.

According to another aspect of the present invention, there is provided a mass spectrometer comprising:

an ion source;

a first AC or RF ion guide disposed in an upstream ion guide vacuum chamber, the first AC or RF ion guide being maintained at a pressure P1;

a second AC or RF ion guide disposed in a downstream ion guide vacuum chamber, the second AC or RF ion guide being maintained at a pressure P2; and a mass analyser disposed in a further vacuum chamber, the further vacuum chamber being disposed downstream of the upstream ion guide vacuum chamber and the downstream ion guide vacuum chamber;

wherein, in use, ions are arranged to be trapped in the first AC or RF ion guide for a time T1 and/or ions are arranged to be trapped in the second AC or RF ion guide for a time T2 wherein P1×T1 is at least 1 mbar-ms and/or P2×T2 is at least 1 mbar-ms.

Preferably, the AC or RF ion guide and/or the further AC or RF ion guide comprises: (i) a multipole rod set; (ii) an ion funnel comprising a plurality of electrodes having apertures therein through which ions are transmitted, wherein the diameter of the apertures becomes progressively smaller or larger; (iii) an ion tunnel comprising a plurality of electrodes having apertures therein through which ions are transmitted, wherein the diameter of the apertures remains substantially constant; (iv) a double helix arrangement of electrodes; and (v) a stack of plates wherein adjacent electrodes are connected to opposite phases of an AC or RF supply.

According to another aspect of the present invention, there is provided a method of mass spectrometry comprising:

operating an AC or RF device in a first mode wherein the AC or RF device acts as an ion guide to substantially transmit ions received at an entrance to the device through to an exit of the device; and operating the AC or RF device in a second mode wherein the AC or RF device acts as an ion trap to substantially trap ions within the device and to substantially prevent the ions from exiting the device, wherein in the second mode the AC or RF device is maintained at a pressure P and ions are trapped within the AC or RF device for a period of time T, wherein the product P×T is at least 1 mbar-ms.

Preferably, the period of time T is a continuous or substantially continuous period of time. Alternatively, the period of time T is an accumulative period of time.

According to another aspect of the present invention, there is provided a method of mass spectrometry comprising ejecting background ions from a mixture of ions by trapping the ions at a pressure>0.01 mbar and for a time>50 μs.

According to another aspect of the present invention, there is provided a mass spectrometer comprising a device for ejecting background ions from a mixture of ions, the device being arranged to trap the ions at a pressure>0.01 mbar and for a time>50 μs.

According to the preferred embodiment ions having a chosen charge state may be selected from a mixture of ions having differing charge states by trapping the ions in an RF device for a period of time and in the presence of a buffer gas at a particular pressure.

Ions generated from an Electrospray Ionisation source, for example, typically contain a mixture of charge states. These ions are usually generated at atmospheric pressure and admitted to the mass spectrometer through means of a pumping aperture that forms part of a differentially pumped vacuum system. In normal operation these ions continually stream through an RF device into regions of lower pressure by means of further differentially pumped regions which lead in turn to a mass analyser housed in an analyser vacuum chamber. The resulting mass spectrum therefore contains ions of all the charge states generated in the ionisation region of the instrument.

If an electrode is placed at the exit of the RF device then ions can be trapped by raising the potential of this gate electrode higher than the body or reference DC potential of the AC or RF device. During this trapping phase ions are preferably still able to enter the device at the upstream end through the differential pumping aperture and hence ions can build up in concentration. If the electrode voltage is reduced then the accumulated ions will be released. By adjusting the pressure in the trapping device it is possible to vary the ratio of singly to multiply charged species.

Various embodiments of the present invention will now be described, by way of example only, and with reference to the accompanying drawings in which.

Figure 4A:
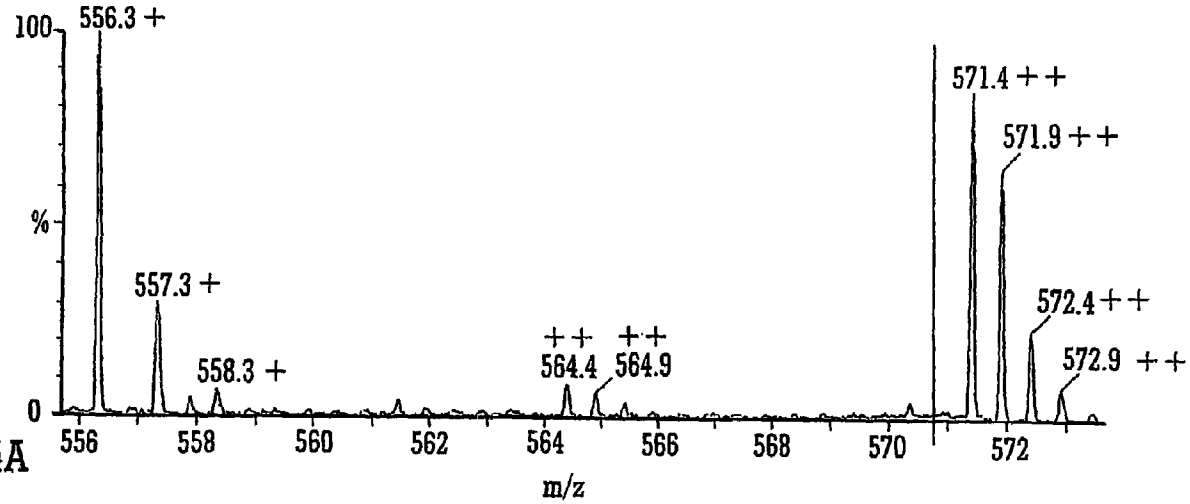
Figure 4B:
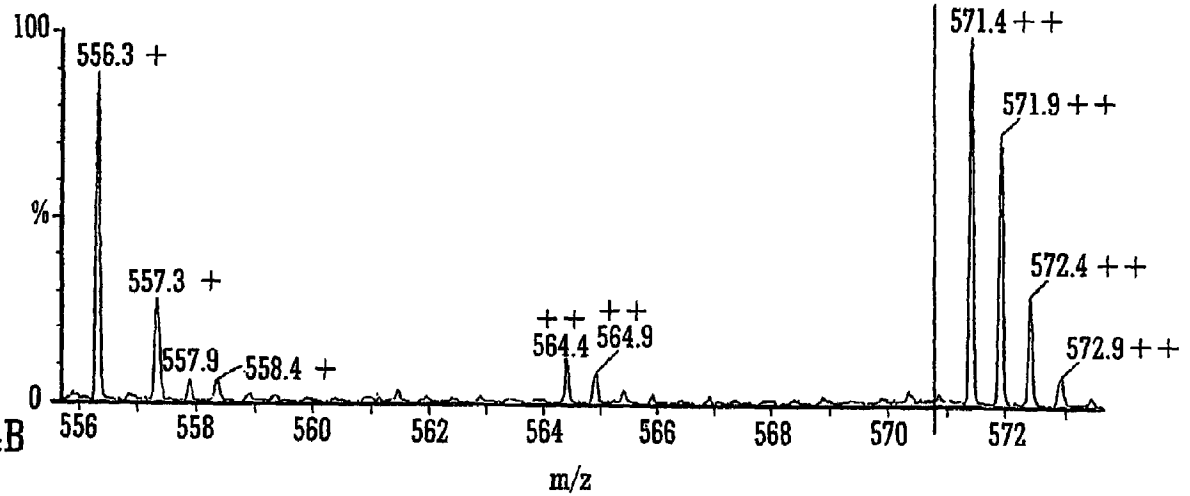
Figure 4C:
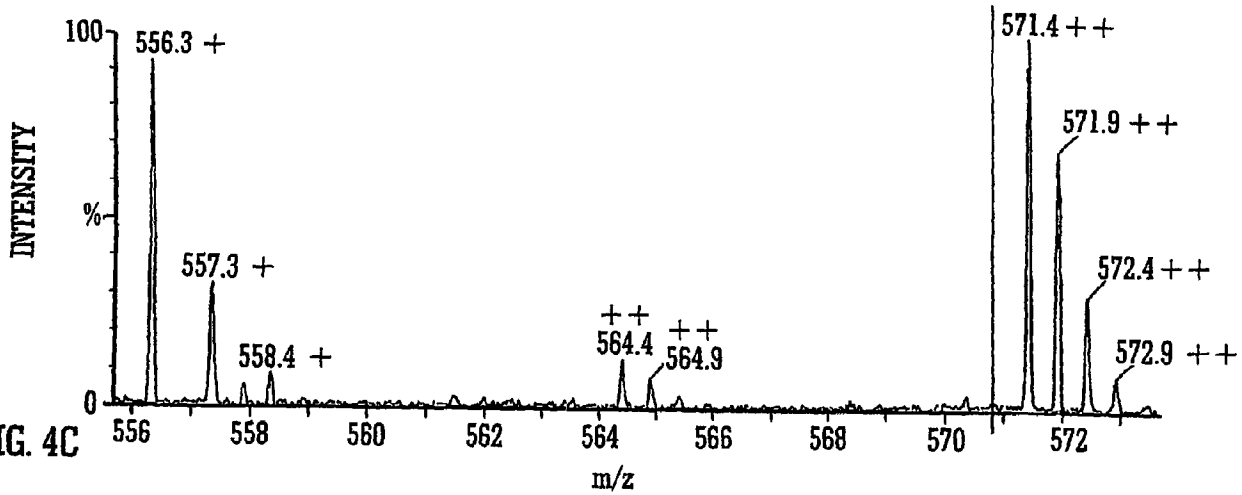
Figure 4D:
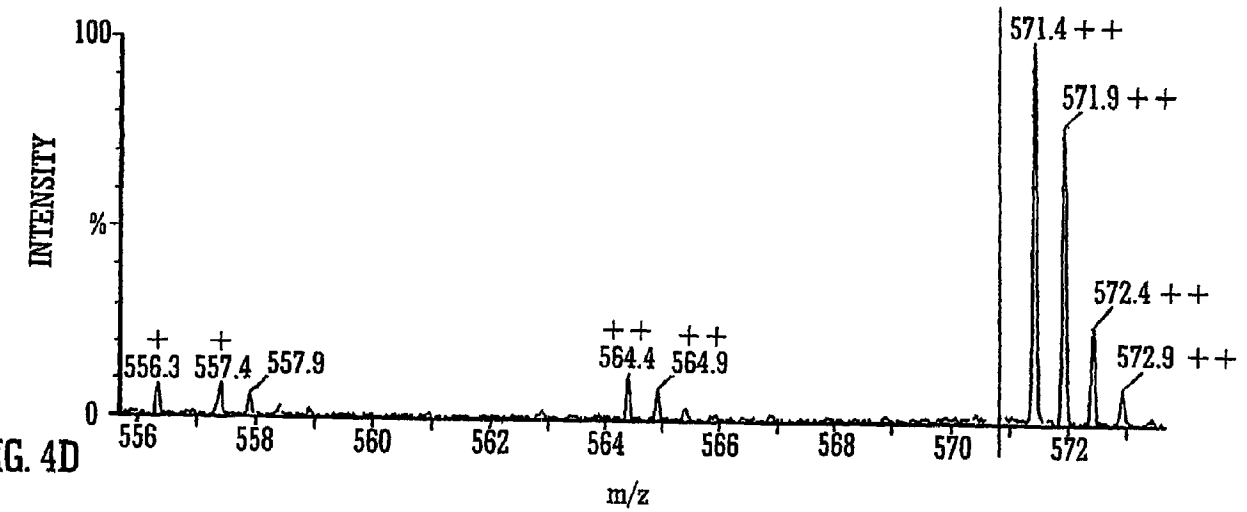
Figures 5A, 5B:
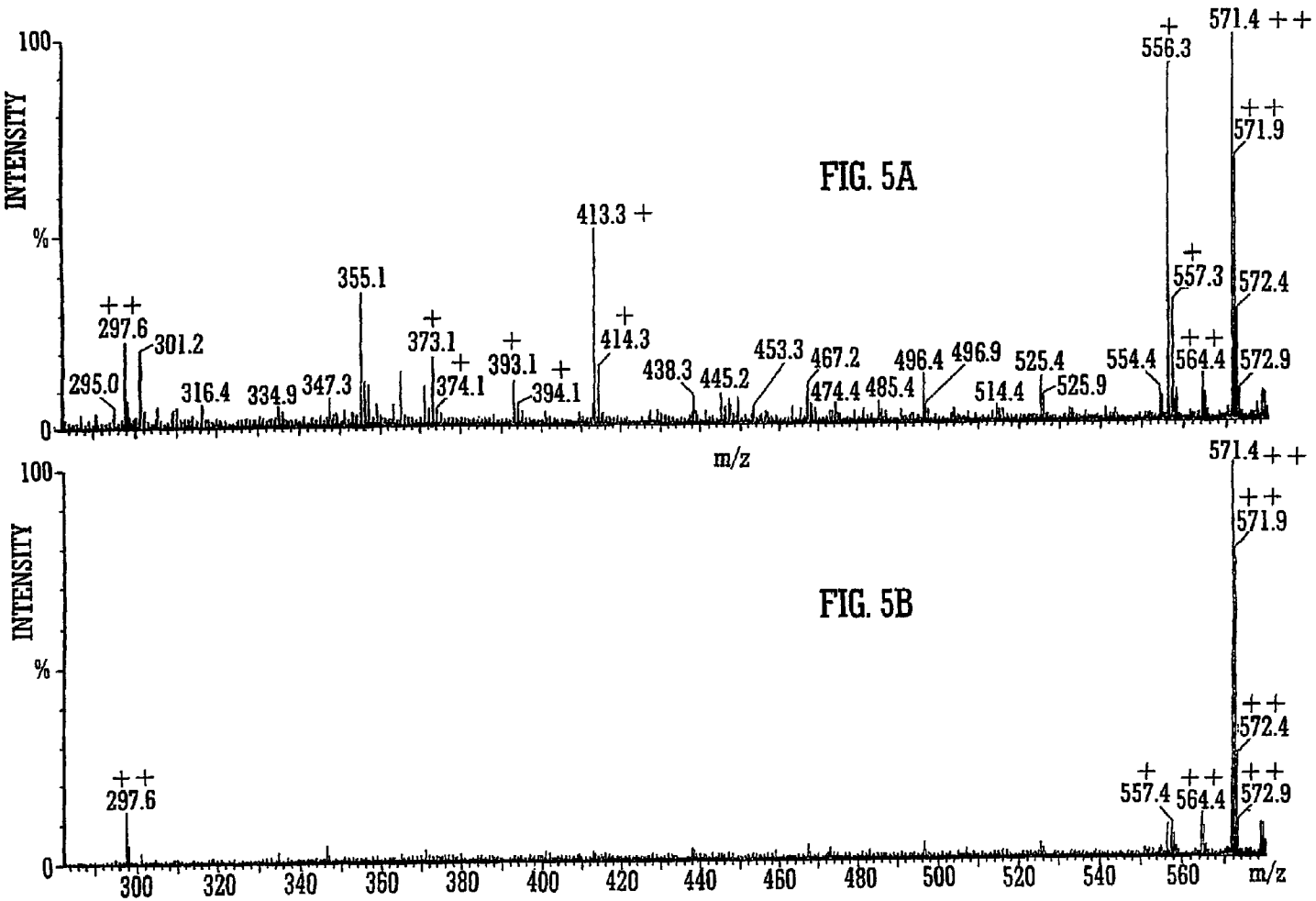
Figure 6A:
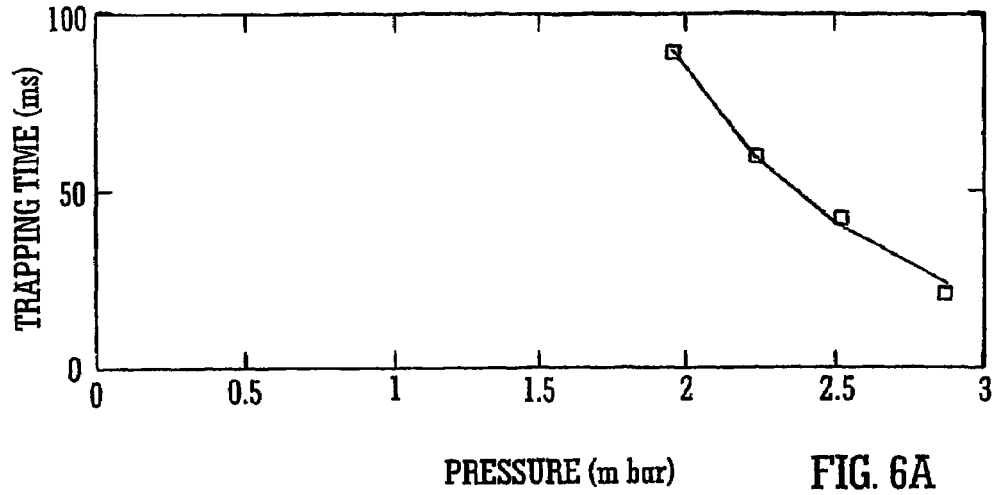
Figure 6B:
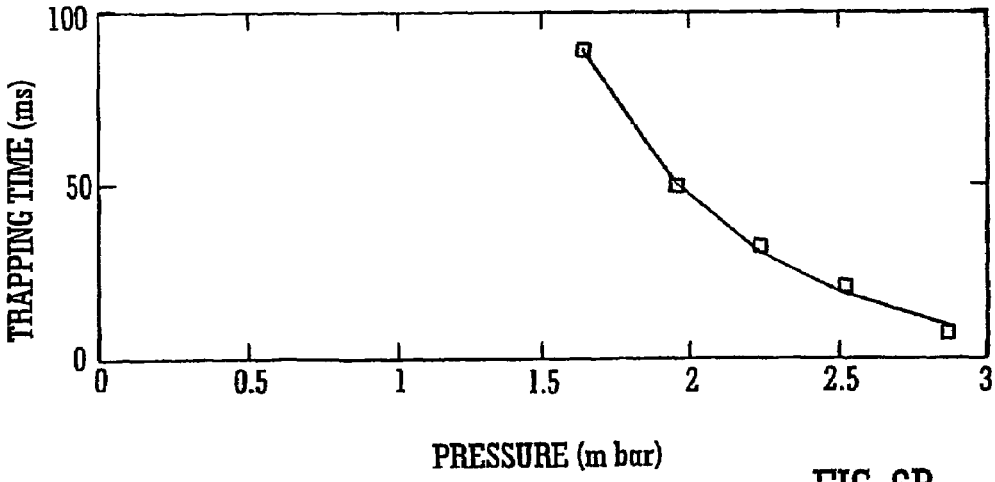
Figure 7:
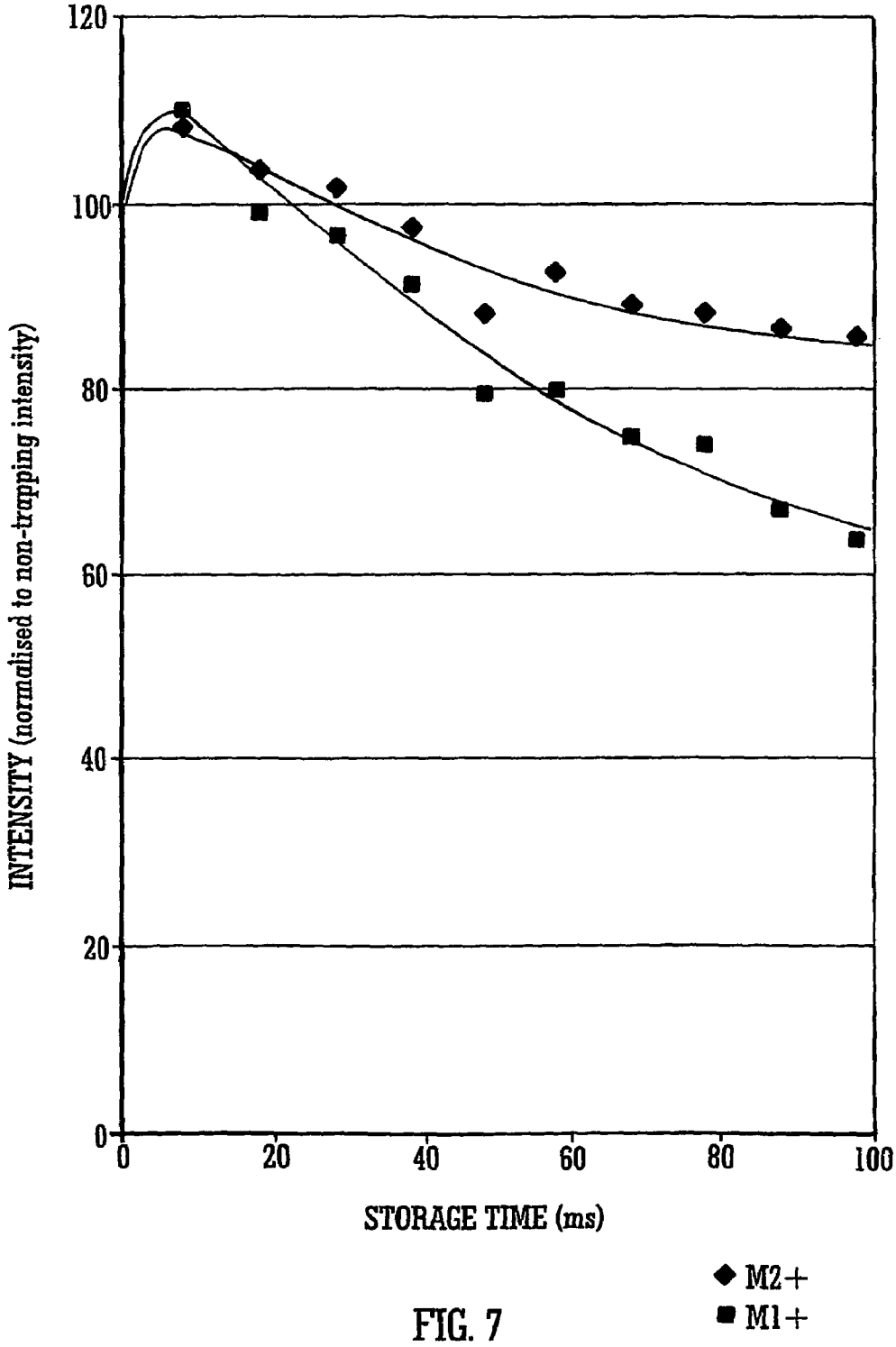
Figure 8:
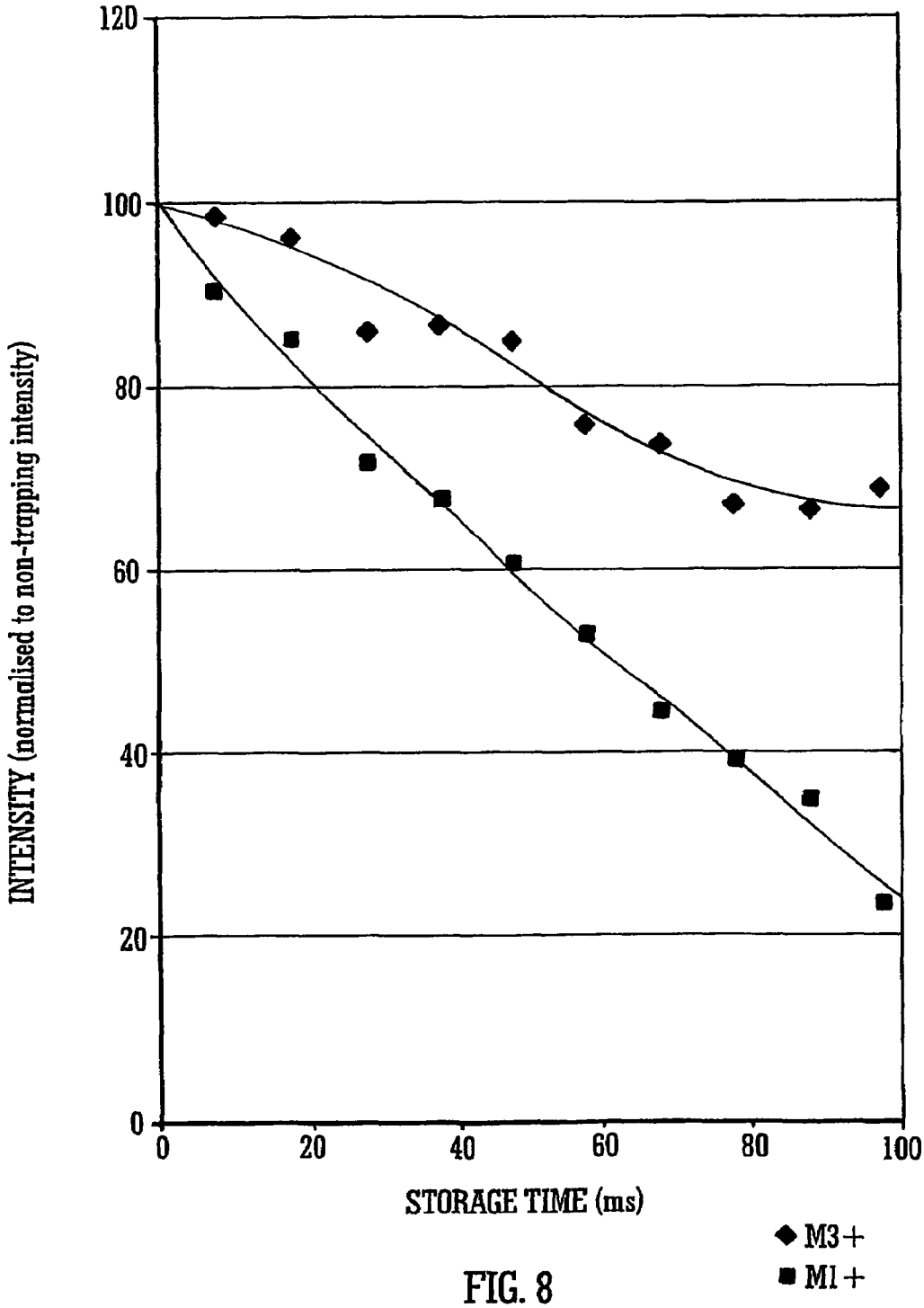
Figure 9:
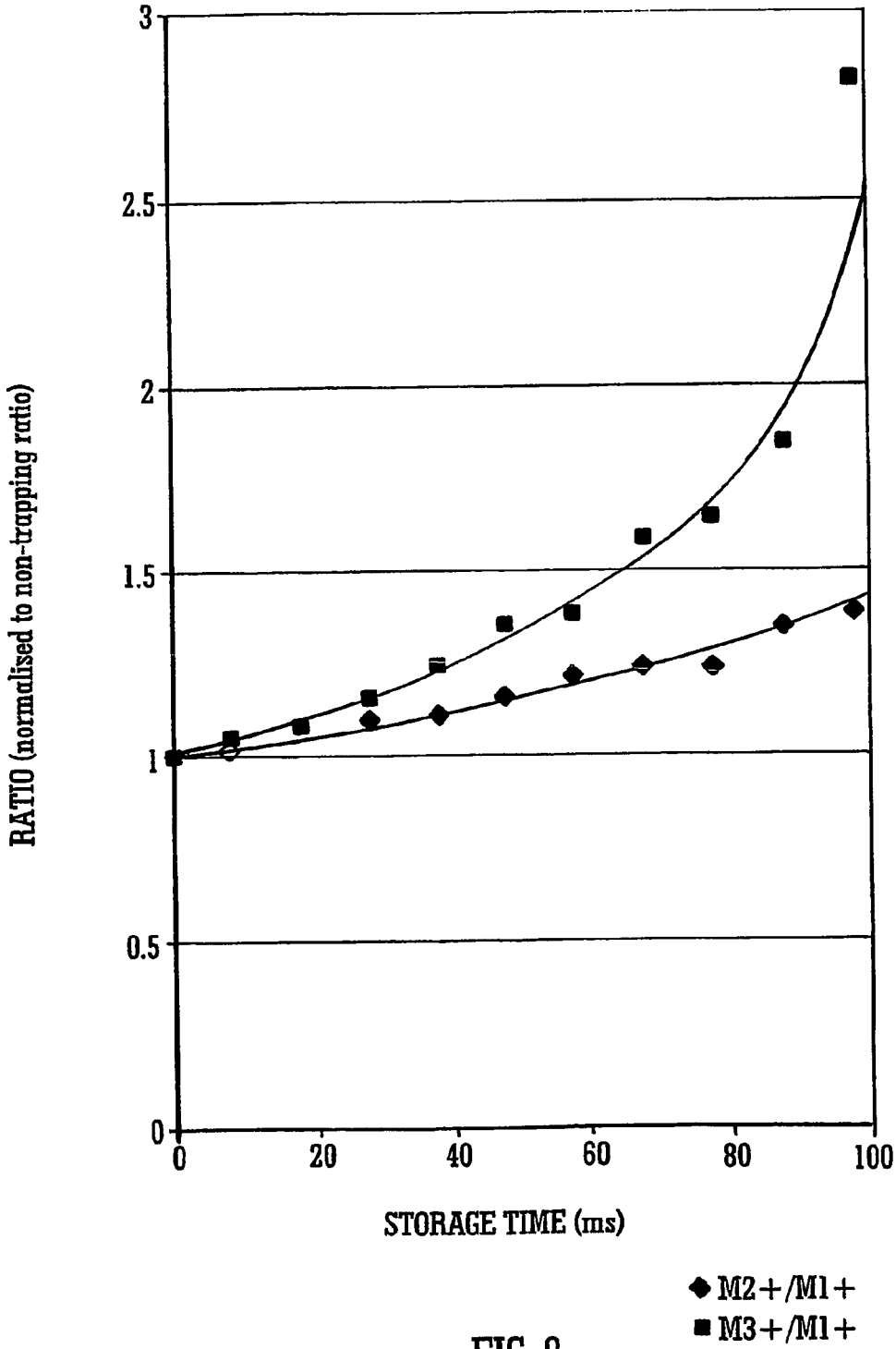
Figure 10:
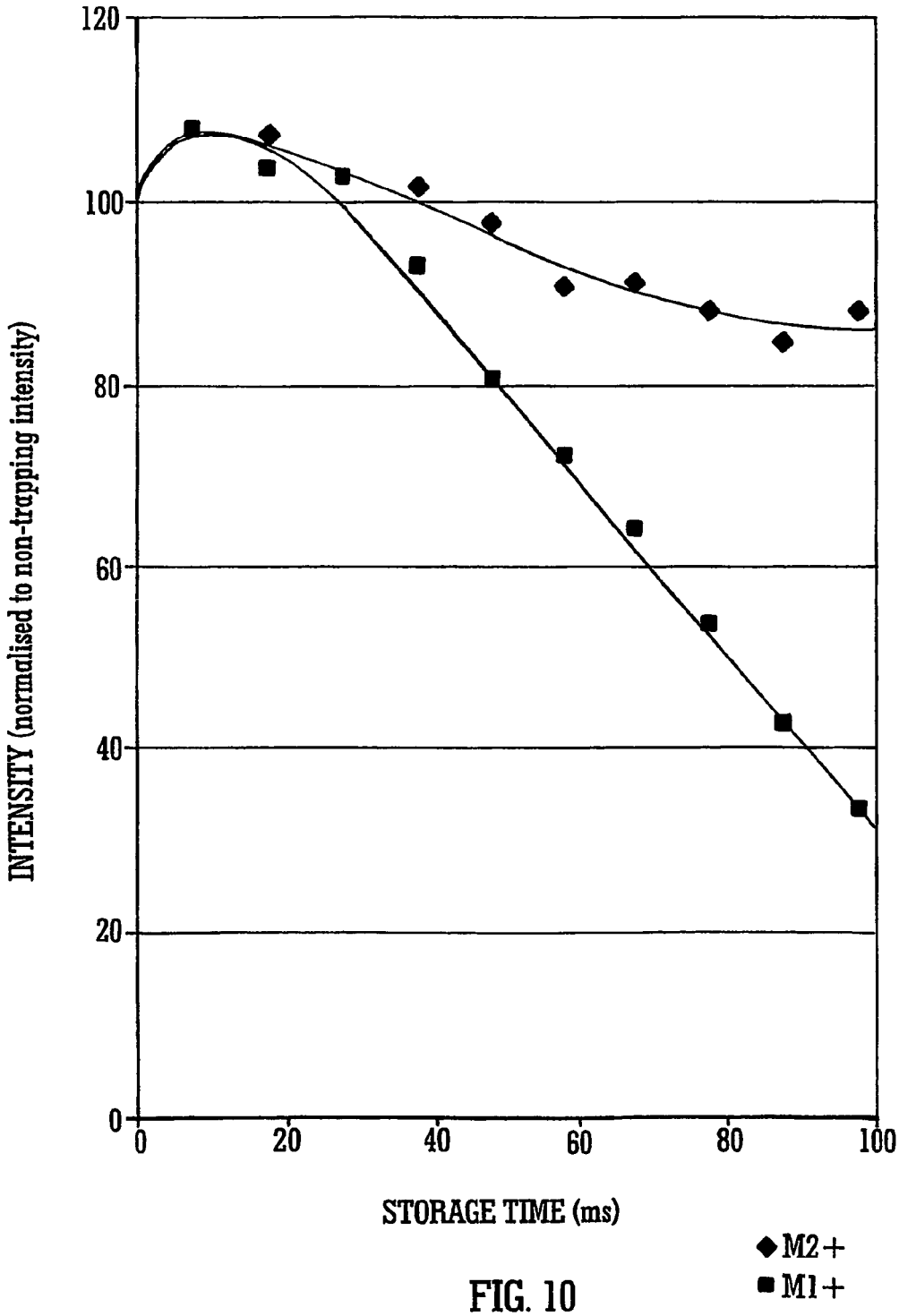
Figure 11:
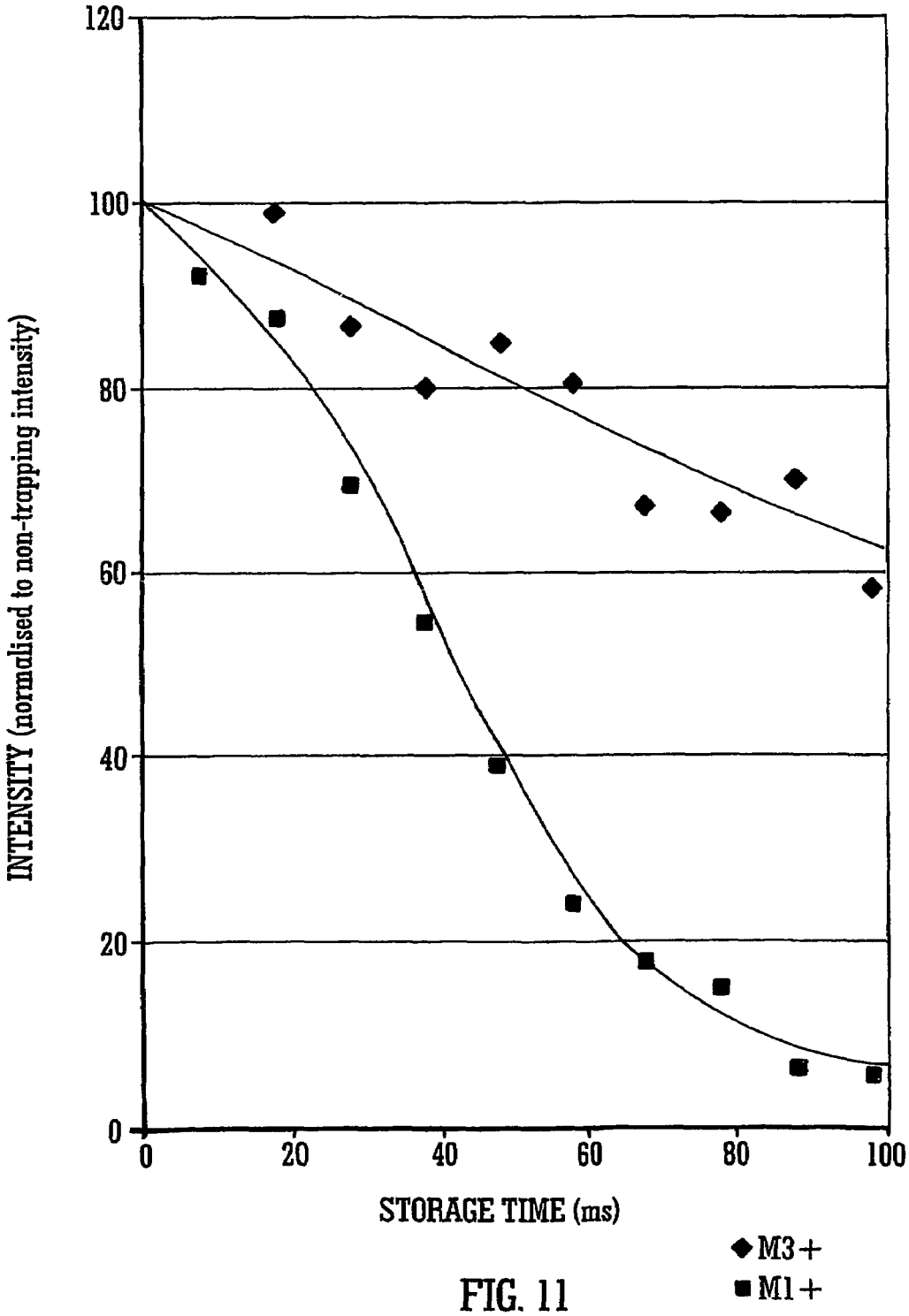
Figure 12:
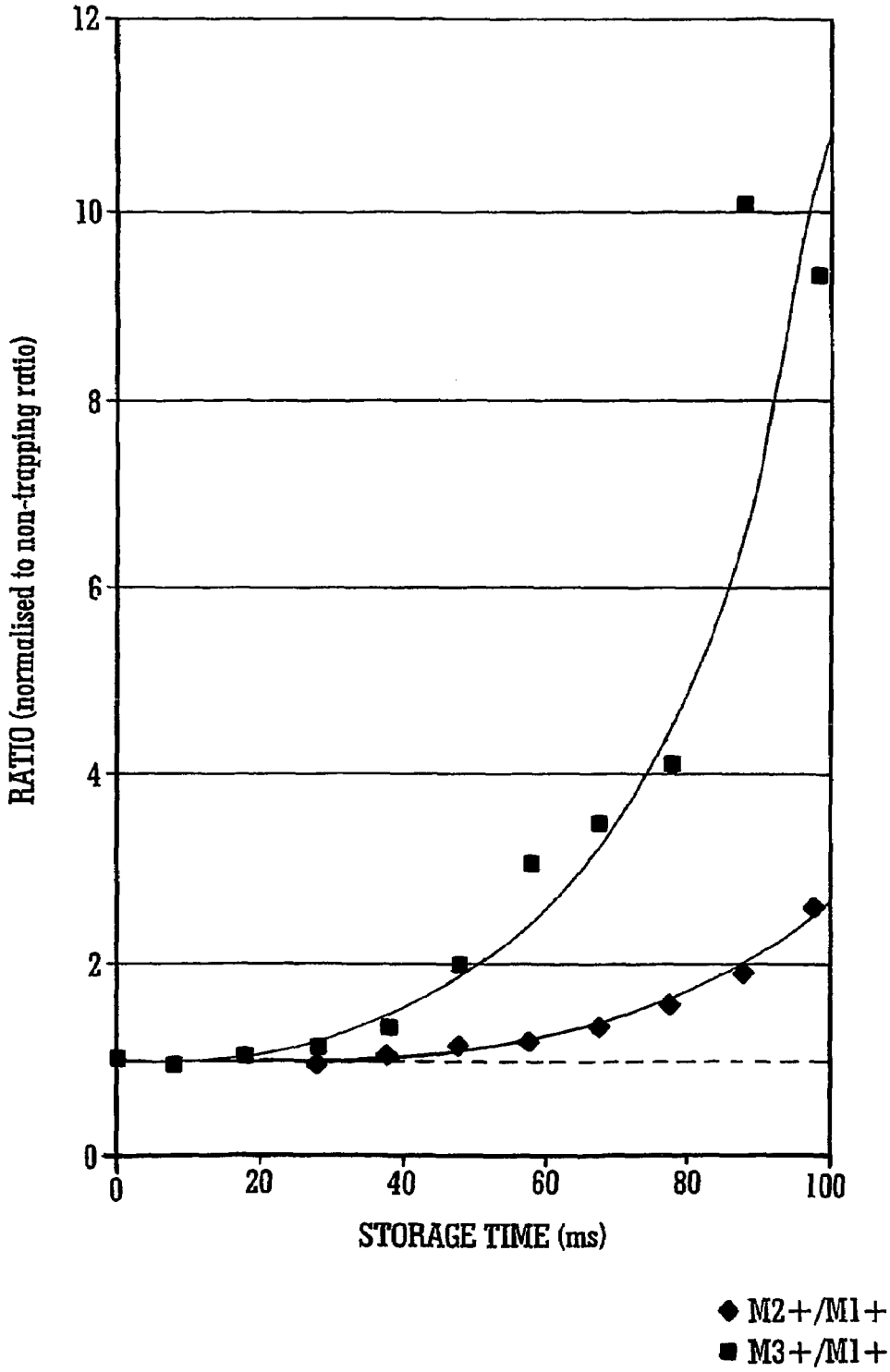
Figure 13:
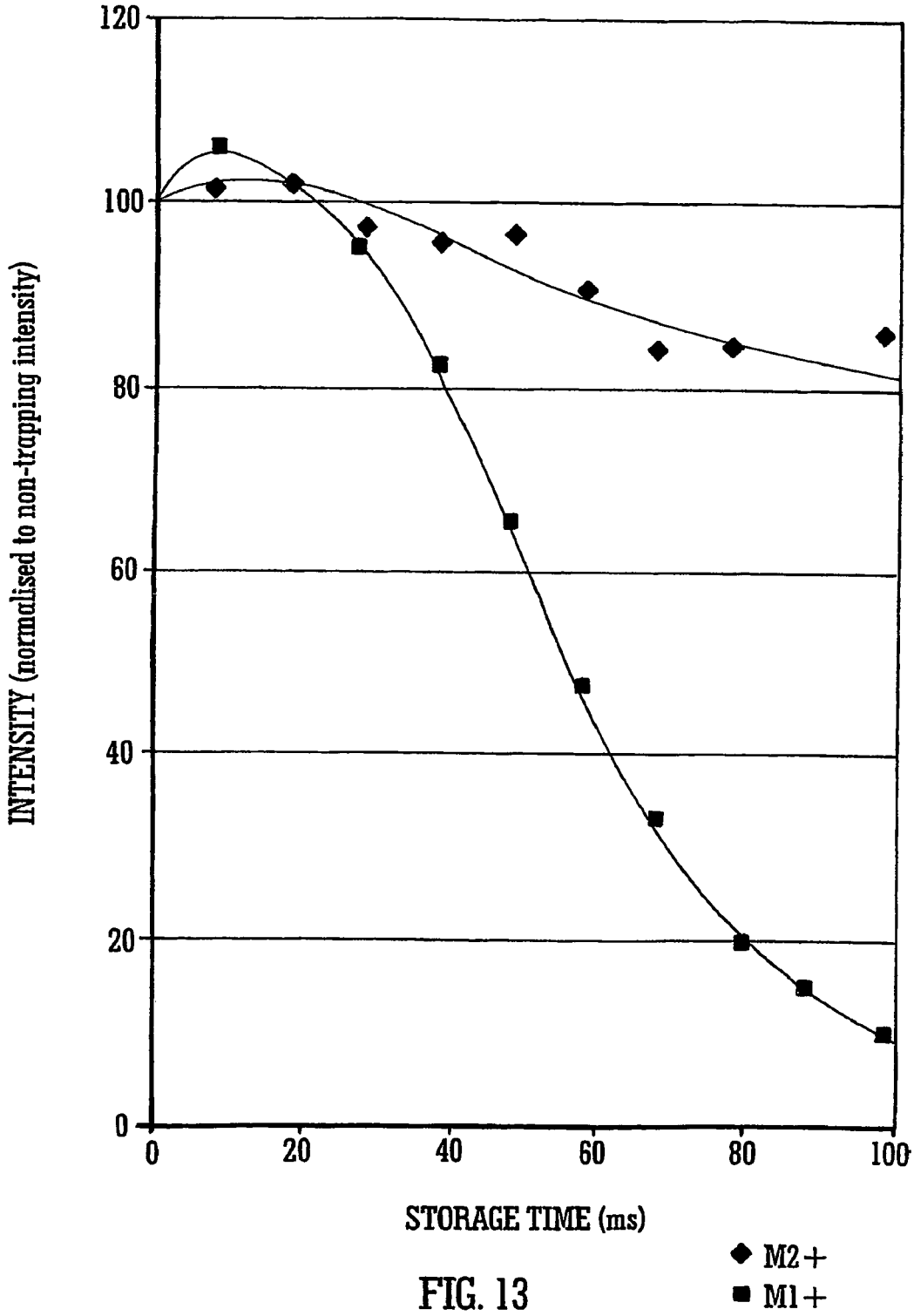
Figure 14:
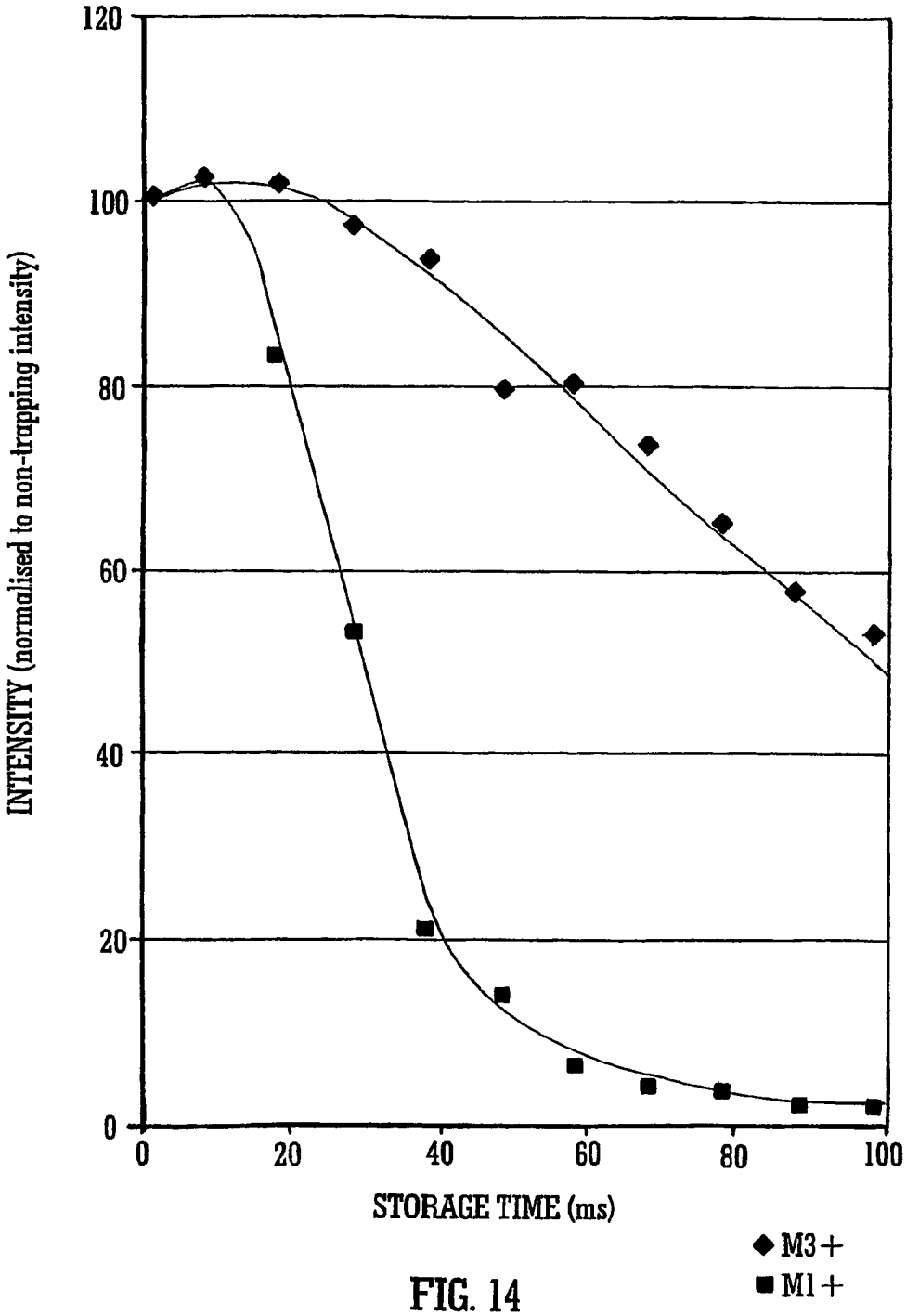
Figure 15:
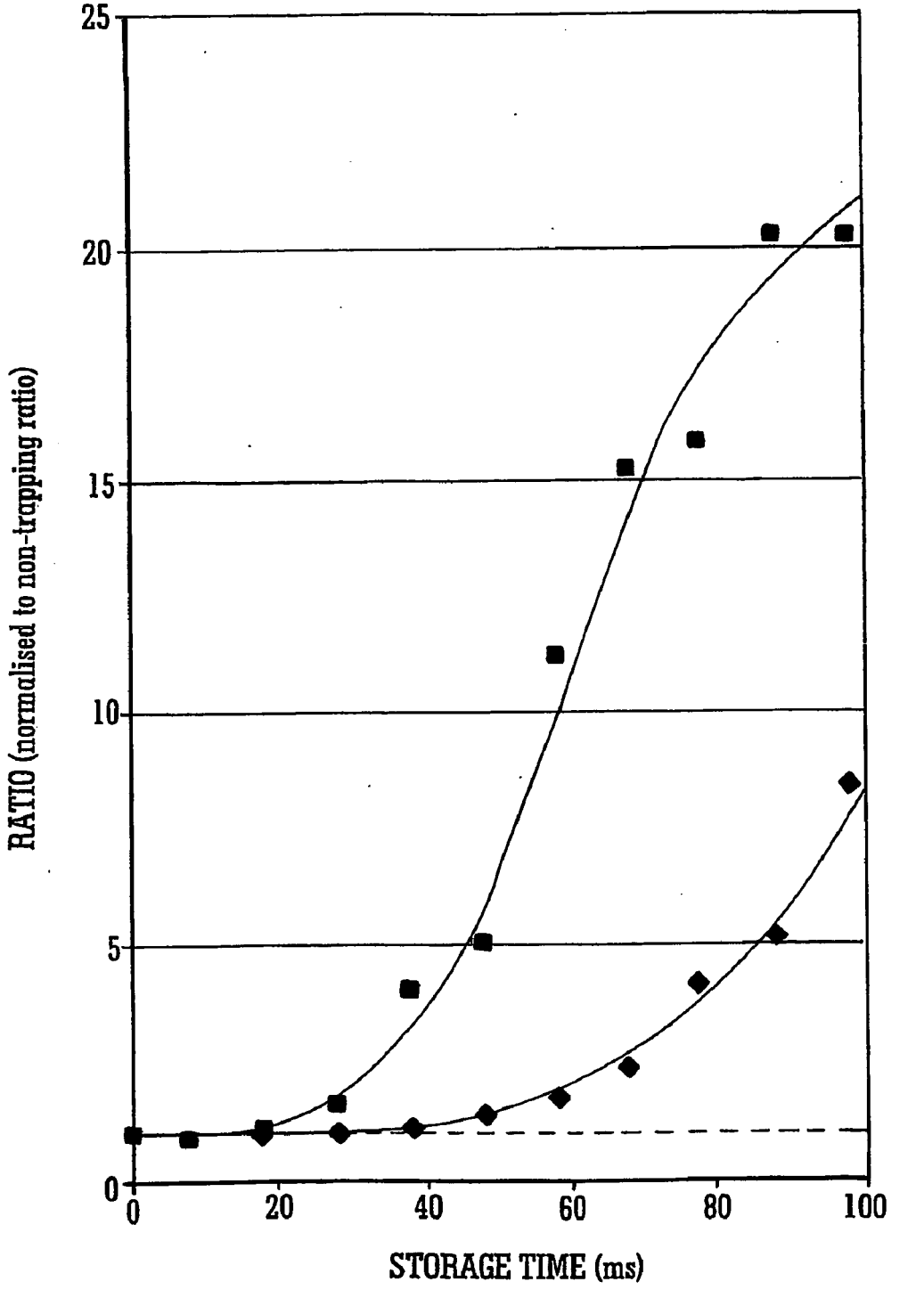
Figure 16:
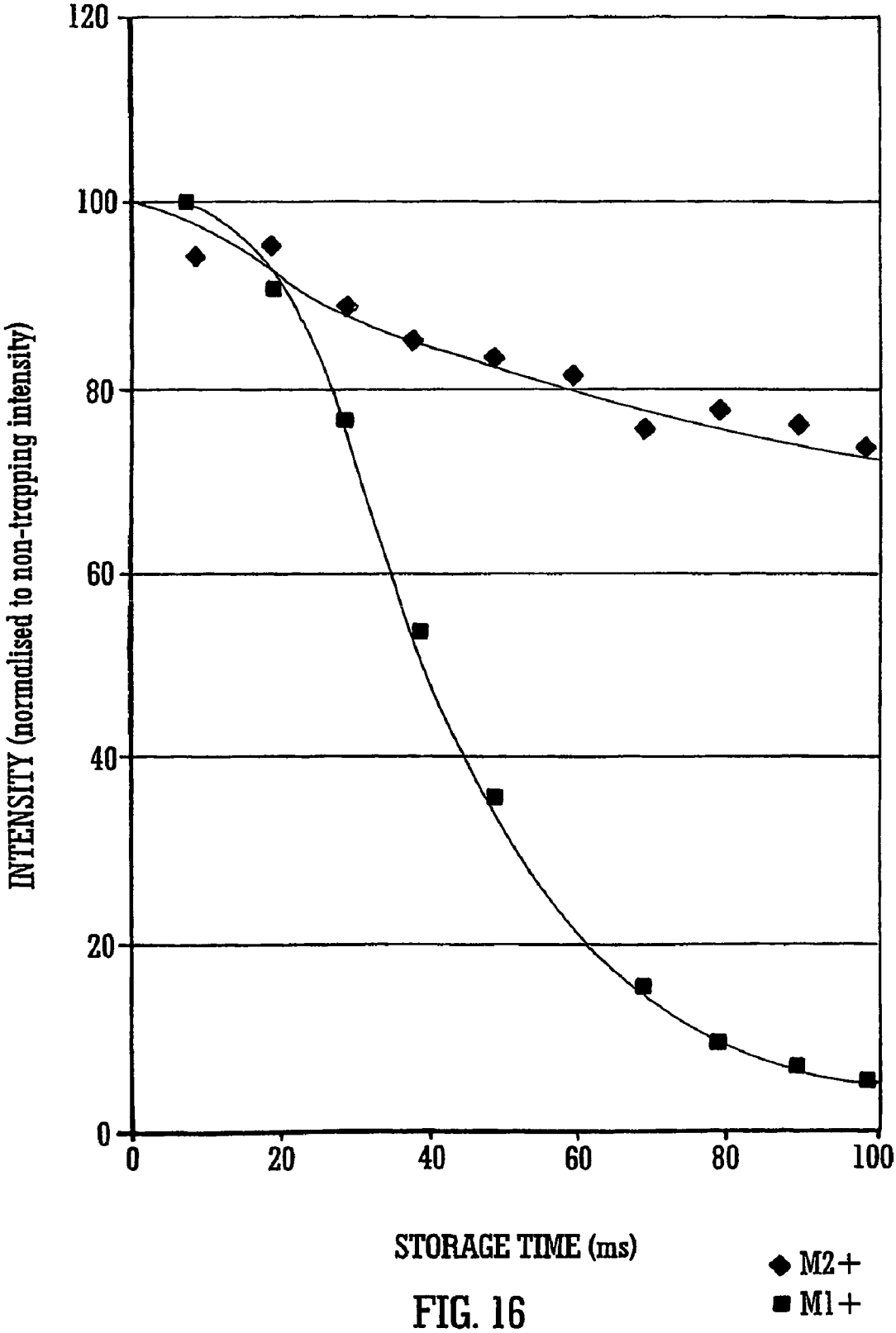
Figure 17:
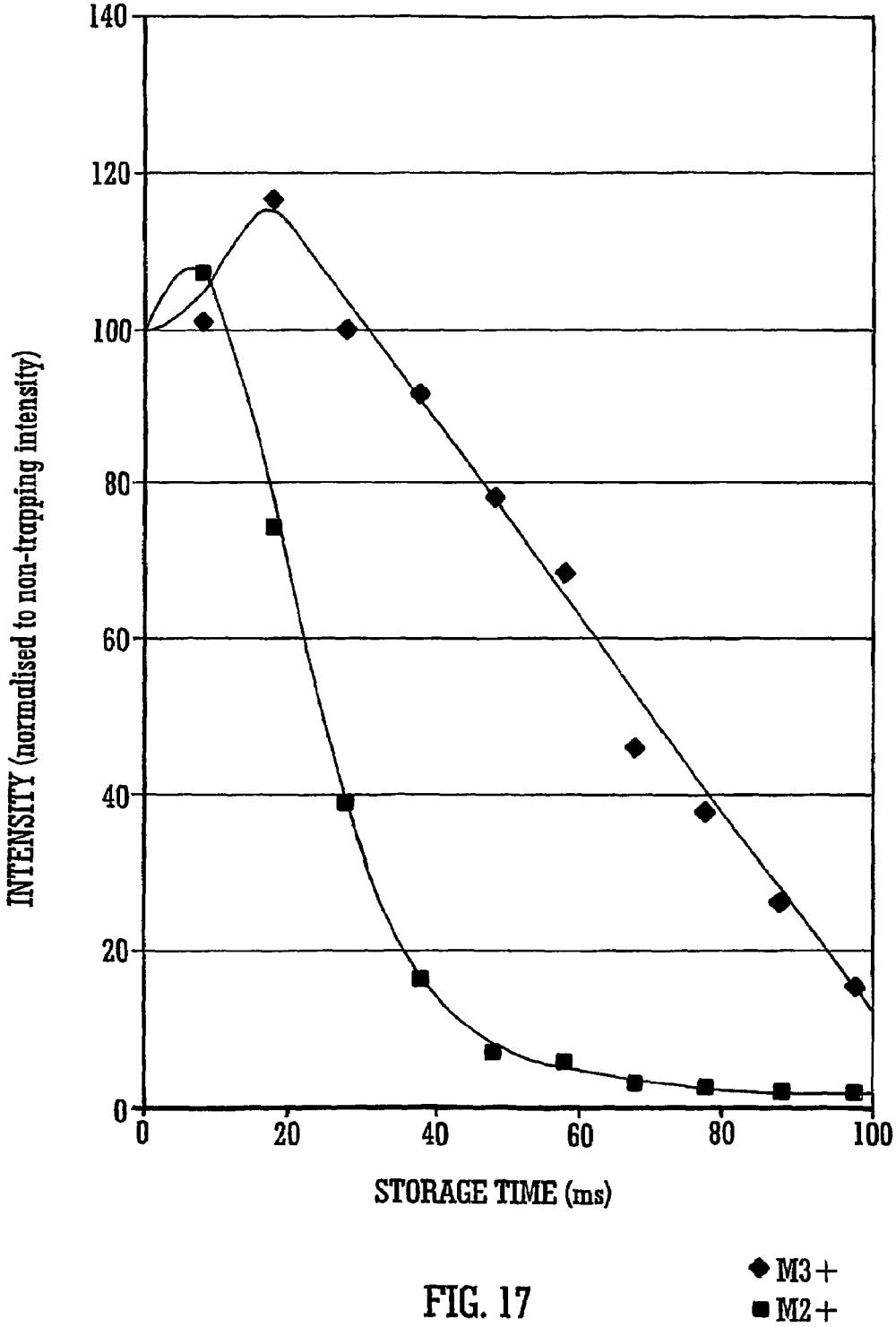
Figure 18:
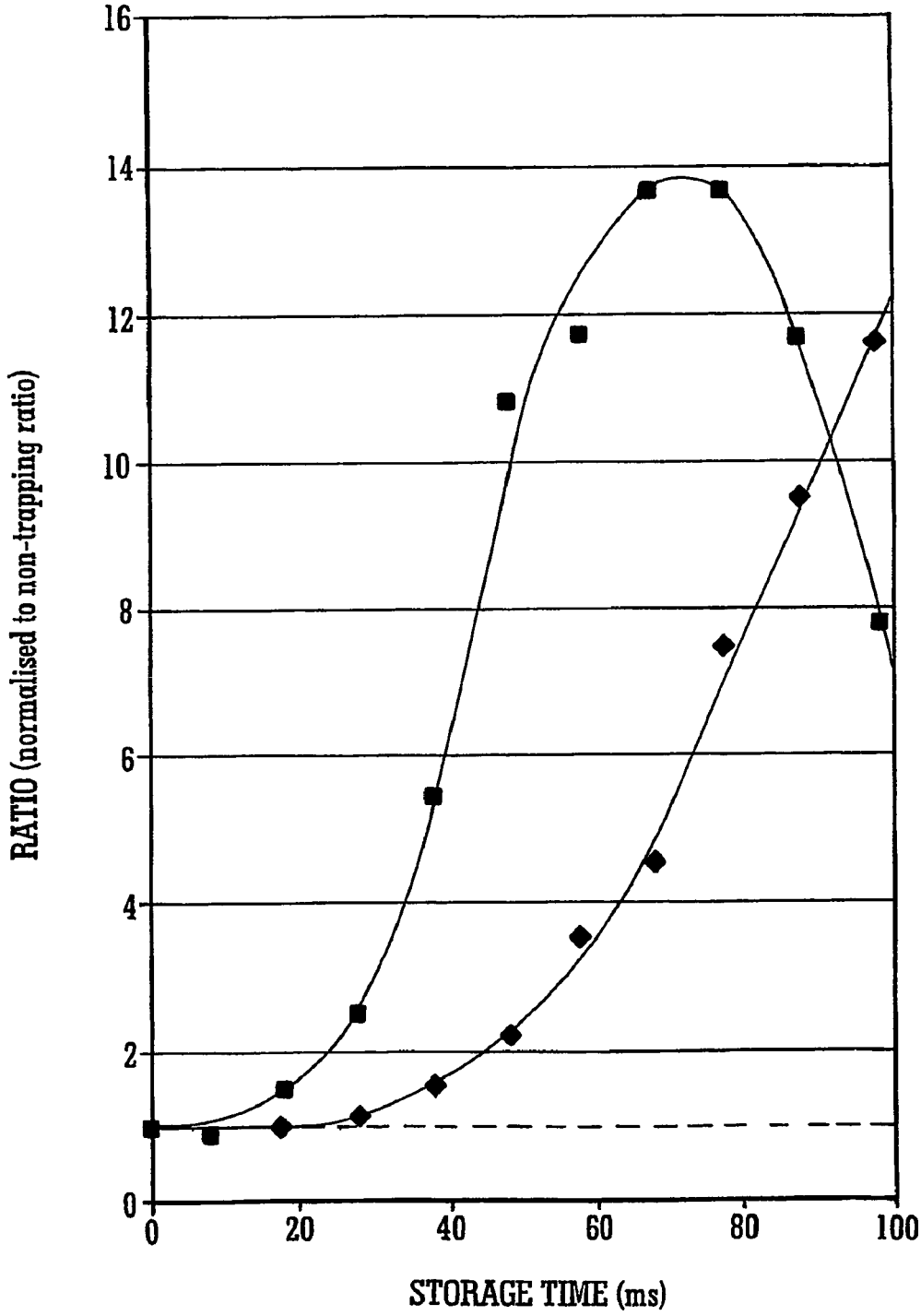
Figure 19:
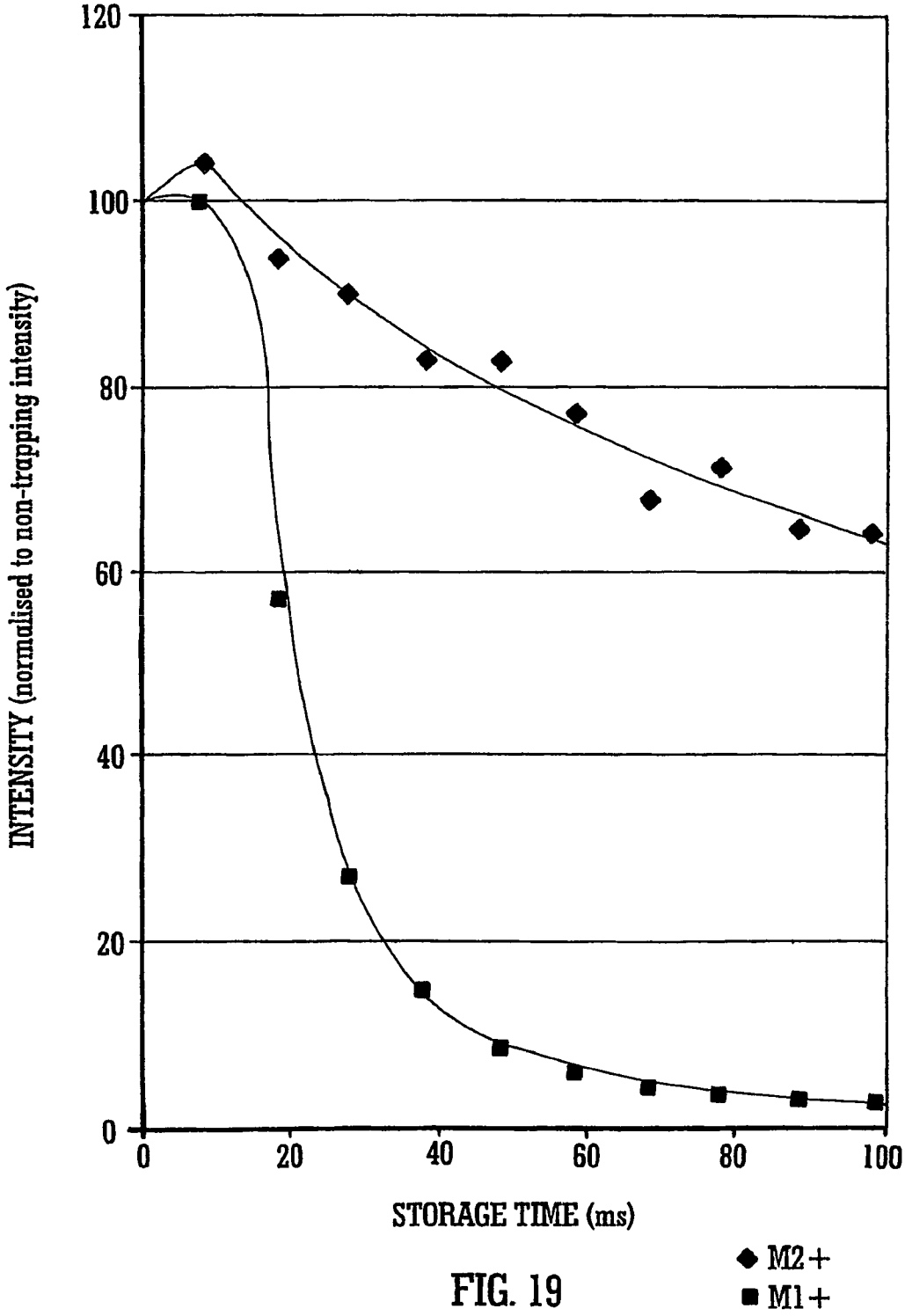
Figure 20:
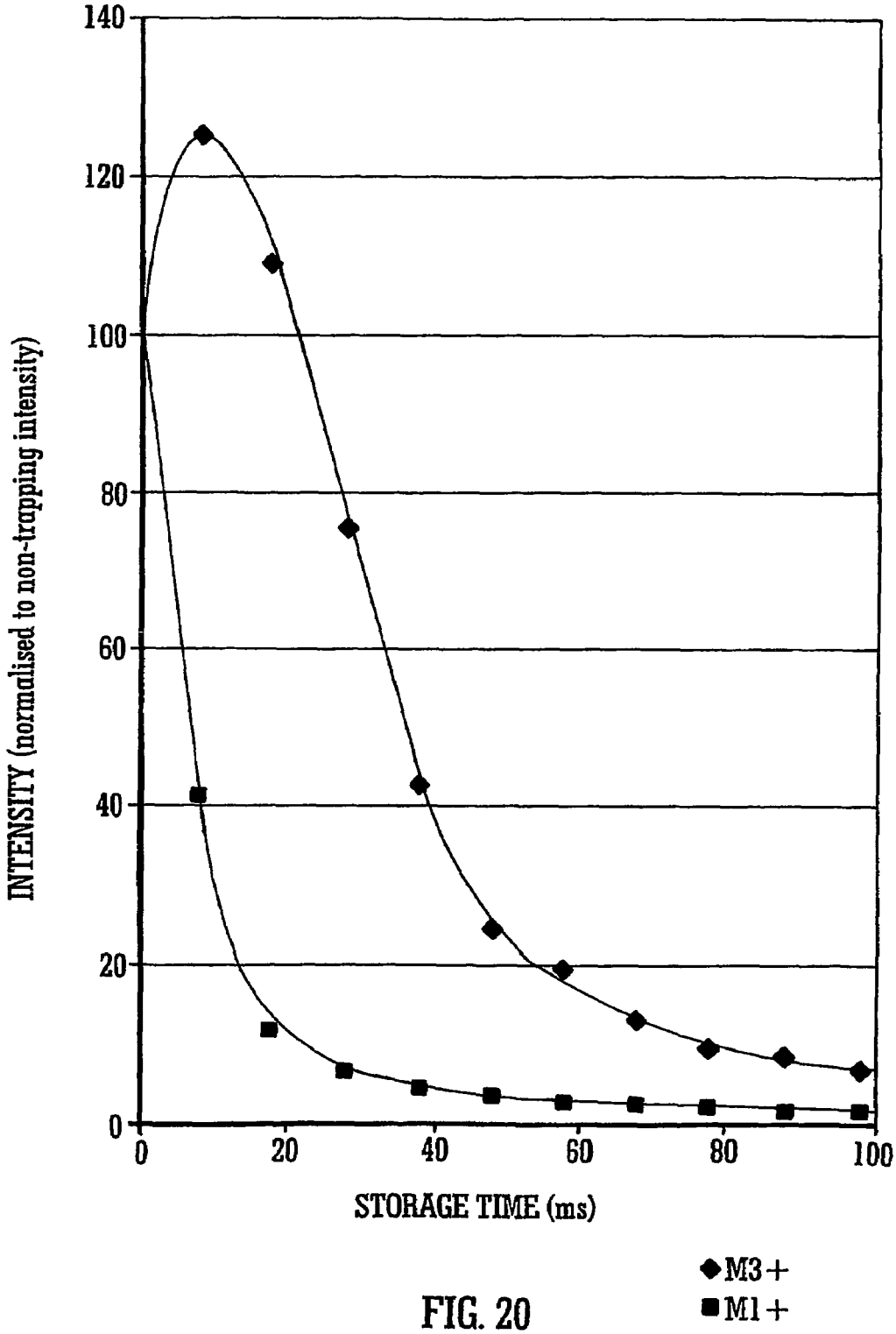
Figure 21:
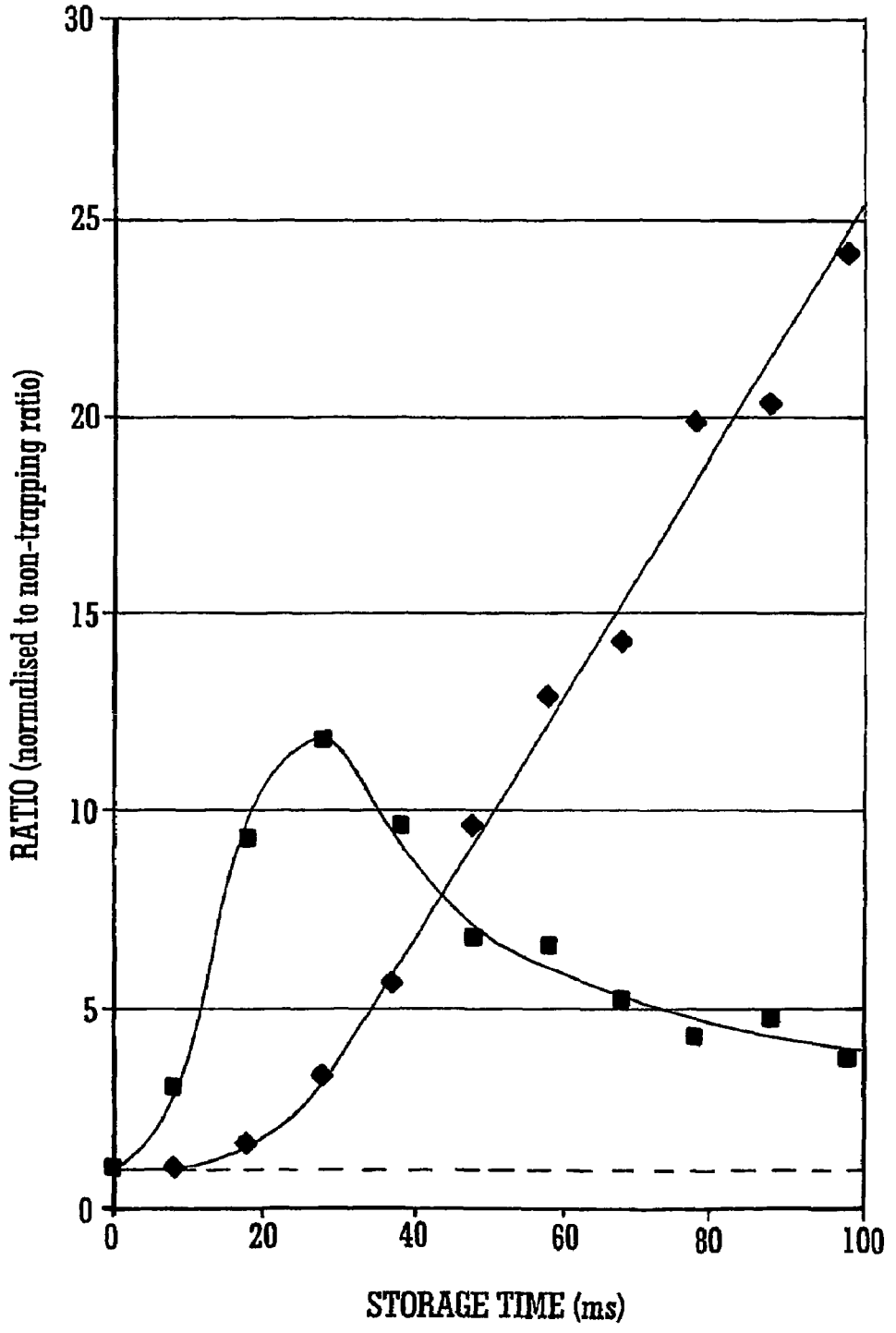

FIG. 4A shows a mass spectrum of ions obtained by guiding ions through the AC or RF device without trapping the ions when the AC or RF device was maintained at a pressure of 1.4 mbar, FIG. 4B shows a mass spectrum of ions obtained by guiding ions through the AC or RF device without trapping the ions when the AC or RF device was maintained at a pressure of 2.7 mbar, FIG. 4C shows a mass spectrum obtained wherein ions were trapped at a pressure of 1.4 mbar for 60 ms, and FIG. 4D shows a mass spectrum obtained according to the preferred embodiment wherein ions were trapped within the AC or RF device at a pressure of 2.7 mbar for 60 ms;

FIG. 5A is an expansion of FIG. 4B and FIG. 5B is an expansion of FIG. 5D;

FIG. 6A shows a plot of trapping time against pressure for which the ratio of the intensity of doubly charged ions from Gramacidin-S (m/z 571) to that of singly charged ions from Leucine Enkephalin (m/z 556) was doubled over that for no trapping and FIG. 6B shows a plot of trapping time against pressure for which the ratio of the intensity of triply charged ions from Renin Substrate (m/z 586) to that of singly charged ions from Leucine Enkephalin (m/z 556) was doubled over that for no trapping;

FIG. 7 shows the effect of storage or trapping time on the intensity of doubly charged Gramacidin-S (m/z 571) ions and singly charged Leucine Enkephalin (m/z 556) ions at 1.64 mbar;

FIG. 8 shows the effect of storage or trapping time on the intensity of triply charged Renin Substrate (m/z 586) ions and singly charged Leucine Enkephalin (m/z 556) ions at 1.64 mbar;

FIG. 9 shows the ratio of intensities of: (i) doubly charged Gramacidin-S ions (m/z 571) to singly charged Leucine Enkephalin (m/z 556) ions; and (ii) triply charged Renin Substrate (m/z 586) ions to singly charge Leucine Enkephalin (m/z 556) ions, as a function of storage or trapping time at 1.64 mbar;

FIG. 10 shows the effect of storage or trapping time on the intensity of doubly charged Gramacidin-S (m/z 571) ions and singly charged Leucine Enkephalin (m/z 556) ions at 1.95 mbar;

FIG. 11 shows the effect of storage or trapping time on the intensity of triply charged Renin Substrate (m/z 586) ions and singly charged Leucine Enkephalin (m/z 556) ions at 1.95 mbar;

FIG. 12 shows the ratio of intensities of: (i) doubly charged Gramacidin-S ions (m/z 571) to singly charged Leucine Enkephalin (m/z 556) ions; and (ii) triply charged Renin Substrate (m/z 586) ions to singly charge Leucine Enkephalin (m/z 556) ions, as a function of storage or trapping time at 1.95 mbar;

FIG. 13 shows the effect of storage or trapping time on the intensity of doubly charged Gramacidin-S (m/z 571) ions and singly charged Leucine Enkephalin (m/z 556) ions at 2.23 mbar;

FIG. 14 shows the effect of storage or trapping time on the intensity of triply charged Renin Substrate (m/z 586) ions and singly charged Leucine Enkephalin (m/z 556) ions at 2.23 mbar;

FIG. 15 shows the ratio of intensities of: (i) doubly charged Gramacidin-S ions (m/z 571) to singly charged Leucine Enkephalin (m/z 556) ions; and (ii) triply charged Renin Substrate (m/z 586) ions to singly charge Leucine Enkephalin (m/z 556) ions, as a function of storage or trapping time at 2.23 mbar;

FIG. 16 shows the effect of storage or trapping time on the intensity of doubly charged Gramacidin-S (m/z 571) ions and singly charged Leucine Enkephalin (m/z 556) ions at 2.51 mbar;

FIG. 17 shows the effect of storage or trapping time on the intensity of triply charged Renin Substrate (m/z 586) ions and singly charged Leucine Enkephalin (m/z 556) ions at 2.51 mbar;

FIG. 18 shows the ratio of intensities of: (i) doubly charged Gramacidin-S ions (m/z 571) to singly charged Leucine Enkephalin (m/z 556) ions; and (ii) triply charged Renin Substrate (m/z 586) ions to singly charge Leucine Enkephalin (m/z 556) ions, as a function of storage or trapping time at 2.51 mbar;

FIG. 19 shows the effect of storage or trapping time on the intensity of doubly charged Gramacidin-S (m/z 571) ions and singly charged Leucine Enkephalin (m/z 556) ions at 2.86 mbar;

FIG. 20 shows the effect of storage or trapping time on the intensity of triply charged Renin Substrate (m/z 586) ions and singly charged Leucine Enkephalin (m/z 556) ions at 2.86 mbar; and FIG. 21 shows the ratio of intensities of: (i) doubly charged Gramacidin-S ions (m/z 571) to singly charged Leucine Enkephalin (m/z 556) ions; and (ii) triply charged Renin Substrate (m/z 586) ions to singly charge Leucine Enkephalin (m/z 556) ions, as a function of storage or trapping time at 2.86 mbar.

Figure 1:
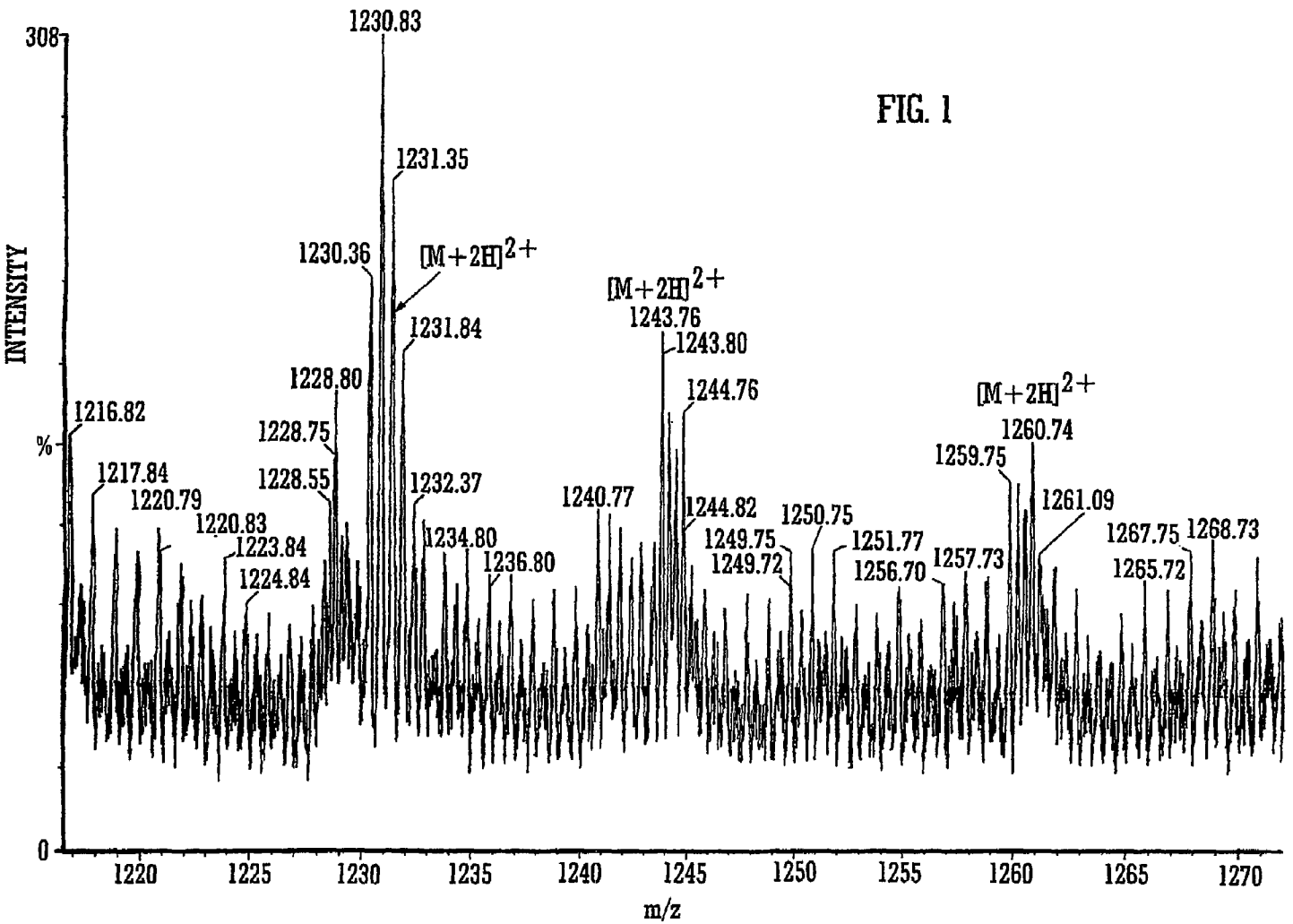
FIG. 1 shows how doubly charged ions may be obscured amongst a background of singly charged ions in a typical mass spectrum.
Figures 2A, 2B:
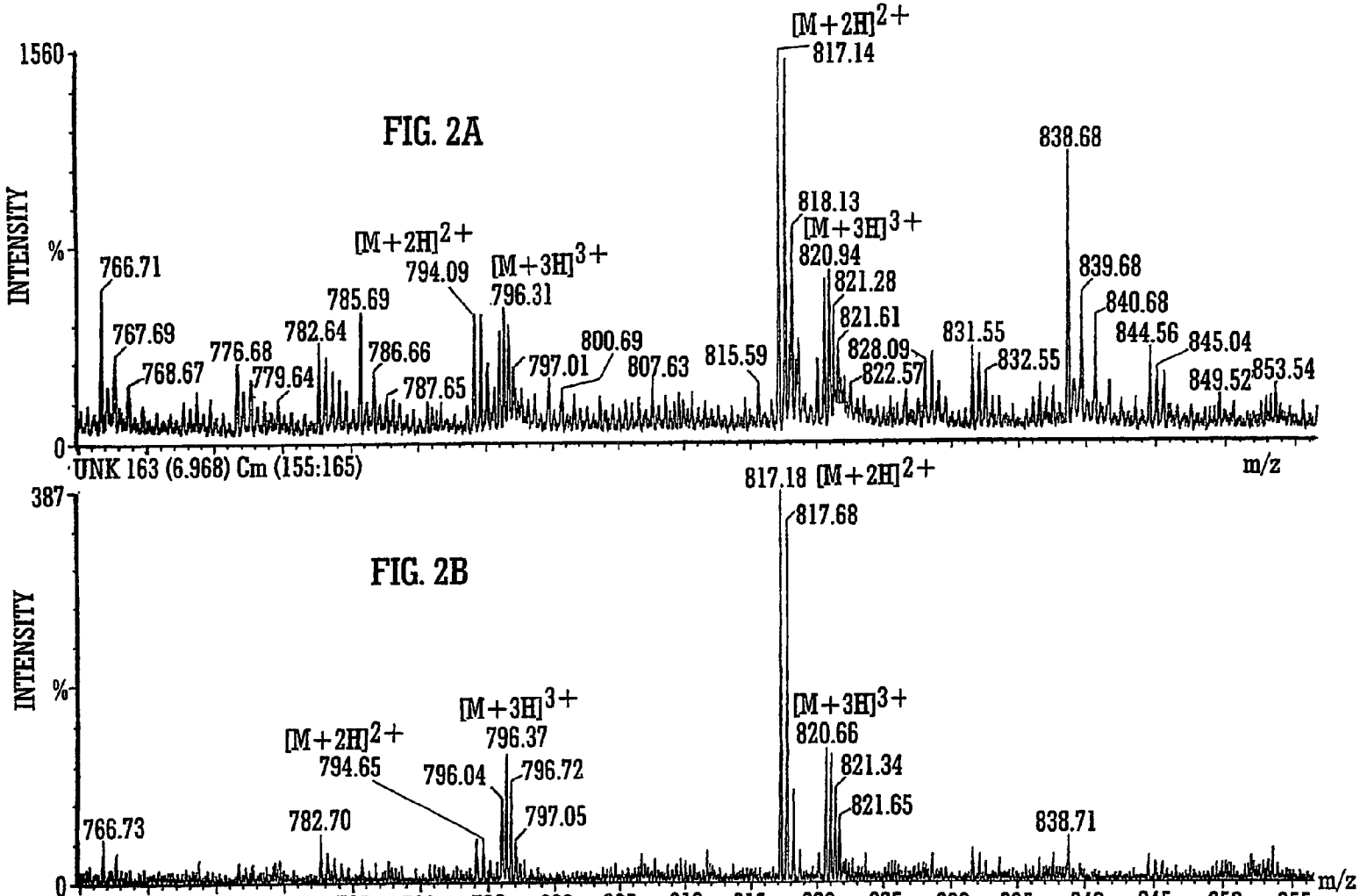
FIG. 2A shows a conventional mass spectrum and FIG. 2B shows a corresponding mass spectrum obtained by lowering the detector gain.
Figure 3A:
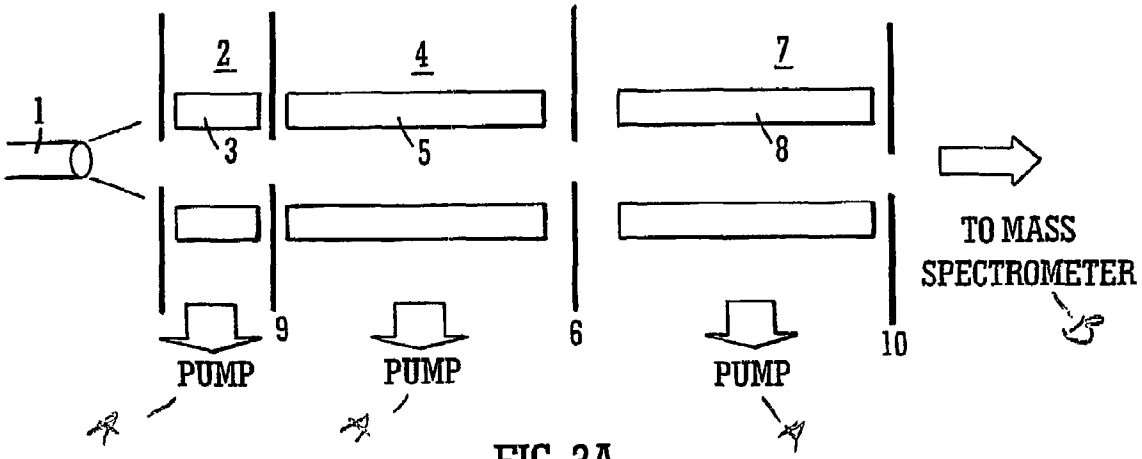
FIG. 3A shows a schematic drawing of a collisional trapping charge state selector device according to the preferred embodiment and FIG. 3B shows a timing diagram for the voltage applied to an electrode adjacent the exit of the AC or RF device.

A preferred AC or RF ion guide/ion trap 5 will now be described in relation to FIG. 3A. Ions from an ion source 1 enter an upstream vacuum chamber 2 which may have an optional RF ion guide 3 arranged therein. However, such an ion guide 3 is not essential and may be omitted. The upstream vacuum chamber 2 is pumped by a pump. Ions pass through a differential pumping aperture 9 into an intermediate vacuum chamber 4. Another RF ion guide 5 is preferably provided in the intermediate vacuum chamber 4 and according to one embodiment this AC or RF ion guide 5 may be operated in one mode of operation as an ion trap. Ions may, for example, be trapped in the guide 5 by raising the potential of a differential pumping aperture 6 which separates the intermediate vacuum chamber from a downstream vacuum chamber 7 preferably housing another RF ion guide 8. The electric field resulting from the voltage applied to the differential pumping aperture 6 preferably extends into the downstream region of the intermediate ion guide 5 and hence has the effect of preventing ions from exiting the ion guide 5. A voltage may or may not be applied to an electrode adjacent an upstream end of the intermediate AC or RF ion guide 5. However, since the differential pumping aperture 9 is preferably maintained at a higher DC potential than the reference DC potential of the intermediate AC or RF ion guide 5 then ions are effectively prevented from exiting the AC or RF ion guide 5 via the entrance. Ions entering the AC or RF ion guide 5 quickly become thermalised i.e. lose their kinetic energy and when a trapping voltage is removed the ions preferably exit the intermediate AC or RF ion guide 5 by the repulsive space-charge effect of further ions entering the ion guide 5. Other embodiments are also contemplated especially in relation to ion tunnel ion guides wherein an axial voltage gradient is used to encourage ions to travel through and/or leave the ion guide(s).

When the potential applied to the differential pumping aperture 6 is lowered, ions may exit the ion guide 5 and pass through the differential pumping aperture 6 into the downstream vacuum chamber 7 which preferably houses a downstream AC or RF ion guide 8. Ions are preferably guided through the downstream vacuum chamber 7 by the ion guide 8 and may then pass through a further differential pumping aperture 10 into an analyser vacuum chamber (not shown) housing a mass analyser (not shown).

Figure 3B:
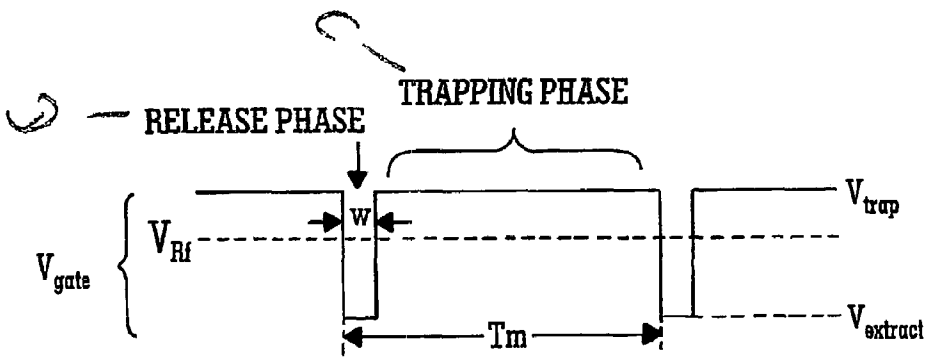

A timing diagram of the voltage applied to the differential pumping aperture 6 or more generally to an exit electrode of the AC or RF ion trap 5 is shown in FIG. 3B. When the differential pumping aperture 6 or the exit to the ion trap 4 is at a voltage $V_{trap}$ then ions are unable to exit the AC or RF ion trap 5 and hence accumulate in the device 5. When the voltage applied to the exit differential pumping aperture 6 or the exit electrode of the AC or RF ion trap 5 falls to $V_{extract}$ then ions are allowed to the exit the ion trap 5 and pass to the next stages and subsequently to the ion detector (not shown).

According to an embodiment the AC or RF ion guide/ion trap 5 is maintained in the intermediate vacuum chamber 4 at a pressure in the range 1-3 mbar. However, according to other embodiments the upstream AC or RF ion guide 3 and/or the downstream AC or RF ion guide 8 may also be used to trap ions therein.

By varying or appropriately setting (i) the pressure in the trapping region, (ii) the cycle time $T_m$, (iii) the release width W and (iv) the voltages $V_{trap}$ and $V_{extract}$ it is possible to maximise the trapping efficiency and to maximise or optimise the discrimination between singly and multiply charged species.

By way of illustration FIGS. 4A and 4B show the mass spectra obtained when the AC or RF device 5 is operated as an ion guide substantially without trapping ions therein (e.g. the voltage applied to the exit of the AC or RF device 5 is maintained at $V_{extract}$. FIG. 4A shows the mass spectrum obtained when the AC or RF device 5 was maintained at a pressure of 1.4 mbar and FIG. 4B shows the mass spectrum obtained when the AC or RF device 5 was maintained at a pressure of 2.7 mbar. In both cases the AC or RF device 5 acted as an ion guide without trapping ions.

All the experimental results presented in the present application were obtained using an AC or RF device which comprised an ion tunnel. An ion tunnel comprises a plurality of electrodes having preferably circular apertures through which ions are transmitted in use. The ion tunnel may therefore be considered to comprise a plurality of stacked rings. According to an embodiment the ion tunnel comprises two interleaved combed arrangements of electrodes. Adjacent electrodes in the ion tunnel device are supplied with opposite phases of an AC or RF voltage supply. The voltage supply is preferably sinusoidal but other embodiments are contemplated wherein, for example, a square wave or other non-sinusoidal waveform may be applied to the device. The ion tunnel device preferably comprises 10-20, 20-30, 30-40, 40-50, 50-60, 60-70, 70-80, 80-90, 90-100 or more than 100 electrodes. Preferably, the vast majority of the electrodes have substantially similar size apertures in contrast to an ion funnel. According to an embodiment at least 75%, 80%, 85%, 90%, 95% or 99% of the electrodes forming the ion tunnel have substantially the same size and/or area internal apertures.

However, the present invention is not limited to using an ion tunnel ion guide and other AC or RF devices are intended to fall within the scope of the present invention.

An equimolar mixture of Leucine-Enkephalin (which exhibits a singly charged peak at m/z 556) and Gramacidin-S (which exhibits a doubly charged peak at m/z 571) was infused into the mass spectrometer. The slight difference in intensities between the two species is largely attributable to differing ionisation efficiencies and is normal in Electrospray mass spectrometry.

FIGS. 4C and 4D show mass spectra obtained when the RF device 5 was operated as an ion trap. Ions were trapped within the ion trap 2 for 60 ms in both cases. FIG. 4C shows the mass spectrum obtained when the ions were trapped for 60 ms in the ion trap 5 at a pressure of 1.4 mbar. As is apparent, FIG. 4C is substantially similar to the mass spectra shown in FIGS. 4A and 4B.

FIG. 4D illustrates an embodiment of the present invention and shows the mass spectrum which resulted from mass analysing the ions which emerged from the ion trap 5 when the ion trap 5 was maintained at a pressure of 2.7 mbar and ions were trapped within the ion trap 5 for 60 ms.

The mass spectra shown in FIGS. 4A, 4B and 4C are qualitatively similar and show that the ratio of the intensity of the doubly charged mass peaks at m/z 571 to the ratio of the intensity of the singly charged mass peaks at m/z 556 remained substantially constant. However, when the ions were trapped at 2.7 mbar for 60 ms then as clearly shown in FIG. 4D singly charged ions were significantly attenuated whilst the doubly charged Gramacidin-S ions at m/z 571 were substantially unattenuated.

FIG. 5A corresponds with the data shown in FIG. 4B and shows the mass spectrum for ions in the mass to charge ratio range 290-580 (as opposed to ions having mass to charge ratios in the range 556-573 as shown in FIG. 4B). Similarly, FIG. 5B corresponds with the data shown in FIG. 4D and shows the mass spectrum for ions in the mass to charge ratio range 290-580 (as opposed to ions having mass to charge ratios in the range 556-573 as shown in FIG. 4D).

As can be clearly seen from FIGS. 5A and 5B singly charged ions present in the sample were rejected from the ion trap 5 when the mixture of ions was trapped at 2.7 mbar for 60 ms whereas doubly charged ions were substantially unattenuated. The peak at mass to charge 297.6 is doubly charged and is substantially unattenuated.

The reasons for the discrimination against singly charged ions in favour of multiply charged ions will now be discussed below. In particular, the distribution of ions within inhomogeneous RF Fields will now be considered.

Through consideration of the average force acting on an ion in the inhomogeneous RF fields it can be shown that the time average of the alternating force is finite and is directed towards the region of weaker field independent of the sign of the ionic charge. This quadratic potential $\phi$ can be expressed as:

$$\Phi=-0.5E_0(\lambda x^2+\sigma y^2+\gamma z^2)$$

The corresponding electric field E may be expressed as:

$$E=E_0(\lambda x+\sigma y+\gamma z)$$

For a quadrupole rod set $\lambda=-\sigma$ and $\gamma$0, and for a quadrupole ion trap $\lambda=\sigma$ and $\gamma=-2\sigma$. For both the quadrupole rod set and the quadrupole ion trap the field is uncoupled in the three directions. Hence, the secular motion is simple harmonic along any given co-ordinate axis.

Evaluation of the kinetic energy along any given co-ordinate axis, averaged over one period, allows the constant W to be determined, where W is a constant of the secular motion corresponding to the total energy in the system with time-independent conservative forces. That is:

$$\begin{aligned} W &= \text{kinetic energy} + \text{pseudo-potential energy} \\ &= \frac{1}{2}m\cdot v^2 + e\Psi \end{aligned}$$

The maximum kinetic energy in the micro-motion of the ion is equivalent to the pseudo-potential energy $e\Psi$. For a quadrupole ion trap the value of the corresponding effective, or equivalent, potential $\Psi$ is given by:

$$\Psi = -\left(\frac{zeE^2}{4m\omega^2}\right)$$

where m is the mass of the ion, z is the charge of the ion, e is the charge of an electron and $\omega$ is the angular frequency of the RF supply.

Through consideration of the pseudo-potential energy $e\Psi$ for multipole rod sets it can also be shown that the effective potential $\Psi(R)$ as a function of the radial distance R is given by:

$$\Psi(R) = -\left(\frac{N^2 zeV_0^2}{4m\omega^2 R_0^2}\right)\left(\frac{R}{R_0}\right)^{2(N-2)}$$

where $V_0$ is the peak RF voltage applied to the rods, $R_0$ in the inscribed radius of the rods, R is the radial distance from the centre and 2N is the number of rods.

Furthermore, it is known that the pseudo-potential energy eΨ for a stacked ring set is proportional to the exponential function of radial displacement R. The effective potential Ψ(R, Z) as a function of the radial distance R and the axial position Z is given by:

$$\Psi(R, Z) = \left(\frac{zeV_0^2}{4m\omega^2 Z_0^2}\right)\frac{\left[I1^2\left(\frac{R}{Z_0}\right)\right]\left[\cos^2\left(\frac{Z}{Z_0}\right)\right] + \left[I0^2\left(\frac{R}{Z_0}\right)\right]\left[\sin^2\left(\frac{Z}{Z_0}\right)\right]}{\left[I0^2\left(\frac{R_0}{Z_0}\right)\right]}$$

where $R_0$ is the inscribed radius of the rings, $nZ_0$ is the ring centre to ring centre separation in the axial direction, I1 is a first order modified Bessel function of the first kind and I0 is a zeroth order modified Bessel function of the first kind.

Through consideration of the effect of ion-molecule collisions in the quadrupole field (F. G. Major and H. G. Dehmelt, Phys. Rev., 1968, 170, 91) it has been shown that when ions of mass m undergo purely elastic collisions within an RF field with relatively cold gas molecules of mass $m_0$ where $m >> m_0$, the collisions will result in viscous drag which lowers the mean kinetic energy of the ions as a function of time. The authors go on to state that the ion micro-motion is not interrupted by the collisions, but only slightly modified in phase and amplitude, while any secular motion is damped out exponentially.

The experimental results presented in the present application show that there is an abundance of doubly charged ions relative to that of singly charged ions following the accumulation of ions in a 2D stacked ring ion guide at a pressures of 2.7 mbar (2 torr) for a trapping period of 60 ms. The data shows enhancement of ions with higher charge states (z values) but with the same m/z values as the product of pressure and storage time is increased.

As already discussed, the effective potential Ψ(R) as a function of the radial distance R for a multipole rod set is given by:

$$\Psi(R) = -\left(\frac{N^2 zeV_0^2}{4m\omega^2 R_0^2}\right)\left(\frac{R}{R_0}\right)^{2(N-2)}$$

Hence by differentiation of the effective potential with respect to R the effective radial field Γ(R) as a function of the radial distance R is given by:

$$\Gamma(R) = -\left[\frac{N^2(N-1)zeV_0^2}{2m\omega^2 R_0^2}\right]\left(\frac{R}{R_0}\right)^{(2\cdot N-3)}$$

Therefore, the radial force F(R) as a function of the radial distance R on ions with mass m and charge z is equal to zeΓ(R). Hence:

$$F(R) = -\left[\frac{N^2(N-1)z^2e^2V_0^2}{2m\omega^2 R_0^2}\right]\left(\frac{R}{R_0}\right)^{(2\cdot N-3)}$$

It will be seen that the radial force F(R) towards the centre is proportional to $z^2/m$. Similarly, the effective potential Ψ(R, Z) as a function of the radial distance R and axial position Z for a ring stack set is given by:

$$\Psi(R, Z) = \left(\frac{zeV_0^2}{4m\omega^2 Z_0^2}\right)\frac{\left[I1^2\left(\frac{R}{Z_0}\right)\right]\left[\cos^2\left(\frac{Z}{Z_0}\right)\right] + \left[I0^2\left(\frac{R}{Z_0}\right)\right]\left[\sin^2\left(\frac{Z}{Z_0}\right)\right]}{\left[I0^2\left(\frac{R_0}{Z_0}\right)\right]}$$

A similar treatment shows that the radial force F(R) towards the centre is again proportional to $z^2/m$. Hence, the radial force is greater for ions of the same mass m with higher charge states z i.e. ions of the same substance with lower m/z values.

However, it will be seen that the radial force F(R) towards the centre is also proportional to z/(m/z). Hence, the radial force is also greater for ions with the same m/z value but with higher values of the charge state z as has been observed.

As a consequence of this, ions with the same values of mass to charge ratio (m/z) but with higher charge states (z) will experience a greater force directed towards the centre where the field is weakest. In an environment where ions are free to move, but frequently in collision with lighter gas molecules, ions that experience the greater radial force will eventually migrate and occupy the central space. Ions that experience a smaller radial force will eventually be squeezed out to occupy larger radial positions. This arranging of ions according to the force acting upon them will only take place in situations where the ions lose their secular motion through collisional damping, and where adequate time has been allowed for the whole population of ions to reach a steady state.

This process by which ions arrange themselves into layers or bands is similar to that which takes place when DNA segments are centrifuged in a caesium chloride density gradient solution to separate out the DNA satellites. In the centrifuge the DNA molecules separate into a number of bands—the main band and three additional bands (satellites). The different satellite bands have different densities depending on whether they are AT-rich or CG-rich segments. This separation of DNA into bands is the result of the different centrifugal forces acting on the different classes of DNA molecules. In a similar manner, ions with the same m/z value, but different z values, will experience different effective radial forces as a result of the effective pseudo-potential well generated by the inhomogeneous RF fields, and will consequentially separate into different bands. Ions with the lower z values will occupy larger radial positions. Hence, these ions are more likely to be lost through collisions with the rods or rings of the ion guide, or not be transmitted through any small orifice arranged along the axis of the ion guide after its exit.

As has already been explained, a method for enhancing the signal from doubly, triply or more highly charged ions from that of background singly charged ions is particularly advantageous for the study of protein digests. The peptides from protein digests, when ionised by electrospray, often yield an abundance of doubly charged, triply or more highly charged ions. The method, as described above, of first storing ions at elevated pressures in an ion guide or ion trap employing inhomogeneous RF fields provides a means of enhancing the relative abundance of multiply charged ions to that of singly charged ions having the same m/z values. This method can therefore be employed before mass analysis so as to enhance the relative abundance of multiply charged ions to that of singly charged ions at equivalent m/z values within the mass spectrum. The relative enhancement of doubly charged ion abundance to that of singly charged ion abundance becomes very pronounced at pressures above 1.4 mbar (1 torr) for storage times of the order of 60 ms. Hence, the enhancement of doubly charged ion abundance to that of singly charged ion abundance becomes very pronounced when the product of pressure and storage or transit time is greater than $8.4\times10^{-2}$ mbar-seconds ($6\times10^{-2}$ torr-seconds).

FIGS. 6A and 6B show the results of further investigations into the relationship between trapping time and pressure. FIG. 6A shows a plot of trapping time (ms) against pressure (mbar) for which the ratio of the intensity of doubly charged ions from Gramacidin-S (m/z 571) to that of the singly charged ions from Leucine Enkephalin (m/z 556) is doubled over that for no trapping. The particular data points are:

| Pressure (P) | Trapping time (T) | P × T |
|---|---|---|
| 1.95 mbar | 89 ms | 173.55 mbar-ms |
| 2.23 mbar | 60 ms | 133.80 mbar-ms |
| 2.51 mbar | 42.5 ms | 106.68 mbar-ms |
| 2.86 mbar | 21 ms | 60.06 mbar-ms |

Pressure and trapping time appear to be exponentially related. An empirically derived relationship for the results shown in FIG. 6A is:

$$T = 1450e^{\frac{-P}{0.70}}$$

where T is the trapping time in ms and P is the pressure in mbar.

FIG. 6B shows a plot of trapping time (ms) against pressure (mbar) for which the ratio of the intensity of the triply charged ions from Renin Substrate (m/z 586) to that of the singly charged ions from Leucine Enkephalin (m/z 556) is doubled over that for no trapping. The particular data points are:

| Pressure (P) | Trapping time (T) | P × T |
|---|---|---|
| 1.64 mbar | 89 ms | 145.96 mbar-ms |
| 1.95 mbar | 50 ms | 97.50 mbar-ms |
| 2.23 mbar | 32 ms | 71.36 mbar-ms |
| 2.51 mbar | 21 ms | 52.71 mbar-ms |
| 2.86 mbar | 7 ms | 20.02 mbar-ms |

Pressure and trapping time again appear to be exponentially related. An empirically derived relationship for the results shown in FIG. 6B is:

$$T = 1750e^{\frac{-P}{0.55}}$$

where T is the trapping time in ms and P is the pressure in mbar.

These results show that by modestly increasing the pressure the required trapping time can be drastically reduced.

FIG. 7 shows the effect of storage or trapping time on the intensity of doubly charged Gramacidin-S (m/z 571) ions and singly charged Leucine Enkephalin (m/z 556) ions at 1.64 mbar, FIG. 8 shows the effect of storage or trapping time on the intensity of triply charged Renin Substrate (m/z 586) ions and singly charged Leucine Enkephalin (m/z 556) ions at 1.64 mbar and FIG. 9 shows the ratio of intensities of: (i) doubly charged Gramacidin-S ions (m/z 571) to singly charged Leucine Enkephalin (m/z 556) ions; and (ii) triply charged Renin Substrate (m/z 586) ions to singly charge Leucine Enkephalin (m/z 556) ions, as a function of storage or trapping time at 1.64 mbar.

FIG. 10 shows the effect of storage or trapping time on the intensity of doubly charged Gramacidin-S (m/z 571) ions and singly charged Leucine Enkephalin (m/z 556) ions at 1.95 mbar, FIG. 11 shows the effect of storage or trapping time on the intensity of triply charged Renin Substrate (m/z 586) ions and singly charged Leucine Enkephalin (m/z 556) ions at 1.95 mbar and FIG. 12 shows the ratio of intensities of: (i) doubly charged Gramacidin-S ions (m/z 571) to singly charged Leucine Enkephalin (m/z 556) ions; and (ii) triply charged Renin Substrate (m/z 586) ions to singly charge Leucine Enkephalin (m/z 556) ions, as a function of storage or trapping time at 1.95 mbar.

FIG. 13 shows the effect of storage or trapping time on the intensity of doubly charged Gramacidin-S (m/z 571) ions and singly charged Leucine Enkephalin (m/z 556) ions at 2.23 mbar, FIG. 14 shows the effect of storage or trapping time on the intensity of triply charged Renin Substrate (m/z 586) ions and singly charged Leucine Enkephalin (m/z 556) ions at 2.23 mbar and FIG. 15 shows the ratio of intensities of: (i) doubly charged Gramacidin-S ions (m/z 571) to singly charged Leucine Enkephalin (m/z 556) ions; and (ii) triply charged Renin Substrate (m/z 586) ions to singly charge Leucine Enkephalin (m/z 556) ions, as a function of storage or trapping time at 2.23 mbar.

FIG. 16 shows the effect of storage or trapping time on the intensity of doubly charged Gramacidin-S (m/z 571) ions and singly charged Leucine Enkephalin (m/z 556) ions at 2.51 mbar, FIG. 17 shows the effect of storage or trapping time on the intensity of triply charged Renin Substrate (m/z 586) ions and singly charged Leucine Enkephalin (m/z 556) ions at 2.51 mbar and FIG. 18 shows the ratio of intensities of: (i) doubly charged Gramacidin-S ions (m/z 571) to singly charged Leucine Enkephalin (m/z 556) ions; and (ii) triply charged Renin Substrate (m/z 586) ions to singly charge Leucine Enkephalin (m/z 556) ions, as a function of storage or trapping time at 2.51 mbar.

FIG. 19 shows the effect of storage or trapping time on the intensity of doubly charged Gramacidin-S (m/z 571) ions and singly charged Leucine Enkephalin (m/z 556) ions at 2.86 mbar, FIG. 20 shows the effect of storage or trapping time on the intensity of triply charged Renin Substrate (m/z 586) ions and singly charged Leucine Enkephalin (m/z 556) ions at 2.86 mbar and FIG. 21 shows the ratio of intensities of: (i) doubly charged Gramacidin-S ions (m/z 571) to singly charged Leucine Enkephalin (m/z 556) ions; and (ii) triply charged Renin Substrate (m/z 586) ions to singly charge Leucine Enkephalin (m/z 556) ions, as a function of storage or trapping time at 2.86 mbar.

It will be seen that in some instances the ion signal can first increase before eventually decreasing as the trapping time is increased. This effect can be observed to a greater or lesser extent in FIGS. 7, 10, 13, 14, 17, 19 and 20. It is thought that the increase in signal intensity is due to ions beginning to migrate towards the centre of the pseudo-potential well as a result of frequent collisions with the lighter gas molecules. This ion migration is likely to be the precursor to the process in which ions with higher values of $z^2/m$ eventually displace ions which have lower values of $z^2/m$ and occupy the central space. Ions that accumulate in the central region are more likely to be transmitted through the exit of the ion guide and to the ion detection system. Hence, ions that initially collapse into the centre of the pseudo-potential well may be expected to show a corresponding increase in signal intensity. In fact, by careful selection of pressure and trapping time, it is possible to enhance the ratio of the intensity of the multiply charged ions with respect to that of singly charged ions with similar m/z values and simultaneously increase the absolute intensity of the multiply charged ions.

If a mass spectrometer is being switched between two modes of operation or is being switched from transmitting ions of one m/z value to those of a different m/z value there will be a period of time for which the mass spectrometer will not be able to receive and transmit ions. In this period of time ions may advantageously be trapped in the AC or RF ion guide/ion trap and then released when the mass spectrometer is ready to accept these ions thereby gaining the advantage of the extra sensitivity that is observed when ions are trapped according to the preferred embodiment described above.

The preferred embodiment also looks particularly useful for preferentially transmitting ions having a large number of charges. For example, horse heart myoglobin has a molecular mass of 16951.48 and ions may in some conditions have 8 or 9 charges or in other conditions the ions may have between 10-28 charges. Experimental data suggests that with highly charged ions preferentially transmission of multiply charged ions in favour of lower or singly charged ions occurs down to pressures P and trapping times T wherein the product P×T is 1 mbar-ms. Experimental data suggests that at or above the product of P×T equaling 1 mbar-ms the beneficial effect of the selective enhancement of multiply charged ions is observed.

Although the preferred embodiment above has been described mainly in relation to preferentially transmitting doubly or triply charged ions as opposed to singly charged ions, the enhancement of highly charged ions to those of e.g. singly charged ions also becomes pronounced at lower products of pressure and storage or transit time.

The preferred embodiment can be used for removing background ions from a mixture of ions, wherein the mixture of ions comprises a plurality of different biopolymers, proteins, peptides, polypeptides, oligionucleotides, oligionucleosides, amino acids, carbohydrates, sugars, lipids, fatty acids, vitamins, hormones, portions or fragments of DNA, portions or fragments of cDNA, portions or fragments of RNA, portions or fragments of mRNA, portions or fragments of tRNA, polyclonal antibodies, monoclonal antibodies, ribonucleases, enzymes, metabolites, polysaccharides, phosphorolated peptides, phosphorolated proteins, glycopeptides, glycoproteins or steroids.

Although the present invention has been described with reference to preferred embodiments and other arrangements, it will be understood by those skilled in the art that various changes in form and detail may be made without departing from the scope of the invention as set forth in the accompanying claims.

The invention claimed is:

1. A method of separating ions having similar or substantially the same mass to charge ratios (m/z) on the basis of their charge state (z), comprising:

trapping said ions within an AC or RF ion guide at a pressure P and for a period of time T, wherein the product P×T is at least 1 mbar-ms, wherein the AC or RF ion guide comprises electrodes and the AC or RF ion guide has a central longitudinal axis, and wherein the combination of pressure and trapping time is such that singly charged ions are forced radially outwards from said central longitudinal axis whereas multiply charged ions are forced towards said central longitudinal axis.

2. A method as claimed in claim 1, wherein said singly charged ions are substantially ejected from or lost from said AC or RF ion guide.

3. A method as claimed in claim 1, wherein at least some or a majority of said multiply charged ions are substantially retained within said AC or RF ion guide.

4. A method as claimed in claim 1, wherein one or more of the following groups of ions are substantially ejected from or lost from said AC or RF ion guide: (i) ions having 2 charges; (ii) ions having 3 charges; (iii) ions having 4 charges; (iv) ions having 5 charges; (v) ions having 6 charges; (vi) ions having 7 charges; (vii) ions having 8 charges; (viii) ions having 9 charges; (ix) ions having 10 charges; (x) ions having 11 charges; (xi) ions having 12 charges; (xii) ions having 13 charges; (xiii) ions having 14 charges; (xiv) ions having 15 charges; (xv) ions having 16 charges; (xvi) ions having 17 charges; (xvii) ions having 18 charges; (xviii) ions having 19 charges; (xix) ions having 20 charges; (xx) ions having 21 charges; (xxi) ions having 22 charges; and (xxii) ions having more than 22 charges.

5. A method as claimed in claim 1, wherein one or more of the following groups of ions are substantially retained with said AC or RF ion guide: (i) ions having 2 charges; (ii) ions having 3 charges; (iii) ions having 4 charges; (iv) ions having 5 charges; (v) ions having 6 charges; (vi) ions having 7 charges; (vii) ions having 8 charges; (viii) ions having 9 charges; (ix) ions having 10 charges; (x) ions having 11 charges; (xi) ions having 12 charges; (xii) ions having 13 charges; (xiii) ions having 14 charges; (xiv) ions having 15 charges; (xv) ions having 16 charges; (xvi) ions having 17 charges; (xvii) ions having 18 charges; (xviii) ions having 19 charges; (xix) ions having 20 charges; (xx) ions having 21 charges; (xxi) ions having 22 charges; and (xxii) ions having more than 22 charges.

6. A method as claimed in claim 1, wherein said electrodes of said AC or RF ion guide comprise a multipole rod set.

7. A method as claimed in claim 1, wherein said electrodes of said AC or RF ion guide comprise a plurality of electrodes having apertures through which said ions are transmitted.

8. A method as claimed in claim 7, wherein said AC or RF ion guide comprises an ion tunnel having said plurality of electrodes each having substantially the same size aperture.

9. A method as claimed in claim 7, wherein said AC or RF ion guide comprises an ion funnel having said plurality of electrodes wherein the size of the apertures becomes progressively smaller or larger.

10. A method as claimed in claim 1, wherein said electrodes of said AC or RF ion guide comprise a double helix arrangement of electrodes.

11. A method as claimed in claim 1, wherein said electrodes of said AC or RF ion guide comprise a plurality of plates stacked adjacent to each other.

12. A method as claimed in claim 1, wherein said period of time T is a continuous or substantially continuous period of time.

13. A method as claimed in claim 1, wherein said period of time T is an accumulative period of time.

* * * * *